US011064849B2

(12) United States Patent
Holbrook et al.

(10) Patent No.: US 11,064,849 B2
(45) Date of Patent: Jul. 20, 2021

(54) AUTOMATIC RAISING AND CONTROLLED LOWERING OF A TOILET SEAT

(71) Applicant: Gmat Ventures, LLC, Salt Lake City, UT (US)

(72) Inventors: Troy A. Holbrook, Holladay, UT (US); Scott A. Holbrook, Salt Lake City, UT (US); Steven R. Hutchinson, Highland, UT (US); Christopher J. Knapp, Salt Lake City, UT (US)

(73) Assignee: Gmat Ventures, LLC, Salt Lake City, UT (US)

( * ) Notice: Subject to any disclaimer, the term of this patent is extended or adjusted under 35 U.S.C. 154(b) by 100 days.

(21) Appl. No.: 16/596,653

(22) Filed: Oct. 8, 2019

(65) Prior Publication Data

US 2020/0037831 A1 Feb. 6, 2020

Related U.S. Application Data

(63) Continuation of application No. 15/936,315, filed on Mar. 26, 2018, now Pat. No. 10,492,650, which is a continuation of application No. 13/720,769, filed on Dec. 19, 2012, now Pat. No. 9,955,828.

(60) Provisional application No. 61/695,580, filed on Aug. 31, 2012.

(51) Int. Cl.
*A47K 13/10* (2006.01)

(52) U.S. Cl.
CPC ..... *A47K 13/10* (2013.01)

(58) Field of Classification Search
CPC ..... A47K 13/10; E03D 5/04
USPC ..... 4/246.1
See application file for complete search history.

(56) References Cited

U.S. PATENT DOCUMENTS

| | | | |
|---|---|---|---|
| 550,006 | A | 11/1895 | Osborn |
| 941,895 | A | 11/1909 | Straw et al. |
| 1,550,006 | A | 8/1925 | Carlson |
| 4,080,669 | A | 3/1978 | Biggerstaff |
| 5,187,818 | A | 2/1993 | Barrett et al. |

(Continued)

FOREIGN PATENT DOCUMENTS

| | | | |
|---|---|---|---|
| JP | 11166258 | A2 | 6/1999 |
| JP | 2002339430 | A2 | 11/2002 |

(Continued)

OTHER PUBLICATIONS

International Preliminary Report on Patentability received for PCT Patent Application No. PCT/US2013/057719, dated Mar. 12, 2015, 8 pages.

(Continued)

*Primary Examiner* — Lauren A Crane
(74) *Attorney, Agent, or Firm* — Patent Law Works LLP

(57) ABSTRACT

Technology associated with automatically raising a toilet seat is described. In an example embodiment, a device for automatically raising a toilet seat includes a fluid-based movement source that generates a force upon actuation and a movement transmission mechanism configured to transfer the force to the toilet seat to raise the toilet seat from a lowered position to a raised position. The fluid-based movement source is fixable to a toilet having a toilet seat and a toilet bowl and the movement transmission mechanism is connected to the fluid-based movement source to receive the force and coupleable to the toilet seat.

7 Claims, 15 Drawing Sheets

(56) References Cited

U.S. PATENT DOCUMENTS

| | | | | |
|---|---|---|---|---|
| 5,307,524 | A * | 5/1994 | Veal | A47K 13/10 4/246.1 |
| 5,504,947 | A | 4/1996 | Robellop et al. | |
| 5,781,938 | A * | 7/1998 | Anderson | A47K 13/10 4/241 |
| 6,351,856 | B1 | 3/2002 | Browne | |
| 6,907,621 | B2 | 6/2005 | Stemen | |
| 8,566,970 | B2 | 10/2013 | Collignon | |
| 8,997,268 | B2 | 4/2015 | Miller et al. | |
| 2003/0154541 | A1 * | 8/2003 | Miller | A47K 13/10 4/246.1 |
| 2007/0056084 | A1 | 3/2007 | Watt et al. | |
| 2007/0089223 | A1 | 4/2007 | Andersen | |
| 2008/0178374 | A1 | 7/2008 | Abrams | |
| 2011/0010831 | A1 | 1/2011 | Lee | |

FOREIGN PATENT DOCUMENTS

| | | | |
|---|---|---|---|
| JP | 2004298275 | A | 10/2004 |
| KR | 1020000024390 | A | 5/2000 |
| WO | 2008107682 | A2 | 9/2008 |

OTHER PUBLICATIONS

International Preliminary Report on Patentability received for PCT Patent Application No. PCT/US2013/076730, dated Jul. 2, 2015, 11 pages.

FlusherUp Executive Summary, pictures of toilets, Aug. 22, 2012, 1pg.

International Search Report and Written Opinion for PCT/US2013/057719, dated Feb. 7, 2017, 14 pages.

International Search Report and Written Opinion for PCT/US2013/076730, dated Apr. 14, 2014, 14 pages.

* cited by examiner

AUTOMATIC RAISING AND CONTROLLED LOWERING OF A TOILET SEAT

CROSS-REFERENCE TO RELATED APPLICATIONS

This application is a continuation of U.S. patent application Ser. No. 15/936,315, entitled "Automatic Raising and Controlled Lowering of a Toilet Seat," filed Mar. 26, 2018, which is a continuation of U.S. patent application Ser. No. 13/720,769, entitled "Automatic Raising and Controlled Lowering of a Toilet Seat," filed Dec. 19, 2012, which claims the benefit under 35 U.S.C. § 119(e) of U.S. Provisional Application No. 61/695,580, entitled "Device for Automatically Raising a Toilet Seat", filed on Aug. 31, 2012, the entire contents of which are incorporated herein by reference.

BACKGROUND

Technical Field

The present disclosure relates to toilets. In particular, the present disclosure relates to automatically raising a toilet seat to a raised position upon the toilet being flushed and lowering the toilet seat in a controlled manner thereafter.

Description of the Related Art

The top of a toilet seat is often soiled because male patrons stand while urinating with the seat in the lowered position resulting in unintended spray or splash of bodily fluids and toilet water on the toilet seat. A subsequent patron who needs to use the seat for sitting is faced with the distasteful choice of sitting on a soiled seat or the task of wiping the seat by hand or placing a paper cover on the seat before sitting to avoid contact with the fluids. To help avoid the unhealthy and unpleasant experience of a soiled toilet seat, some current implementations have taught the use of relatively complicated and expensive means of returning and maintaining the toilet seat in the raised position after being manually lowered by a patron and/or the ineffectual use of other devices requiring user action or a thin paper cover on the seat, which oftentimes doesn't provide an adequate barrier from the fluids. These are not satisfactorily practical solutions because each is overly complicated, expensive, ineffectual, and/or requires user courtesy and action—all factors contributing to such devices not being used or not being used consistently or properly.

SUMMARY

Technology for automatically raising a toilet seat from the lowered position to an upright position upon the toilet being flushed, for lowering the toilet seat in a controlled manner thereafter, and for conserving water based on the position of the toilet seat is described. In one innovative aspect, a device for automatically raising a toilet seat and for lowering the toilet seat in a controlled manner includes a fluid-based movement source that generates a force upon actuation and a movement transmission mechanism configured to transfer the force to the toilet seat to raise the toilet seat from a lowered position to a raised position. The fluid-based movement source is fixable to a toilet having a toilet seat and a toilet bowl and the movement transmission mechanism is connected to the fluid-based movement source to receive the force and is coupleable to the toilet seat.

The device and other embodiments may each optionally include one or more of the following features. For instance, the device may include that the fluid-based movement source is actuatable by a fluid flow regulated by a flush valve of the toilet to generate the force; that the fluid-based movement source includes an adjustable regulator to regulate the amount of the force that is generated; that the movement transmission mechanism includes a lifting and lowering mechanism and a seat coupling device; that the lifting and lowering mechanism is connected to the fluid-based movement source to receive the force and connected to the seat coupling device to transfer the force via the seat coupling device to the toilet seat; that the seat coupling device is adjustable to accommodate a plurality of different toilet seat configurations and may be positioned on either side of the toilet; that the seat coupling device is configured to contact the toilet seat; that the seat coupling device includes a lever arm that is positioned to contact the toilet seat; the seat coupling device is integrated with the toilet seat; that, when receiving the force from the lifting and lowering mechanism, the seat coupling device pivots about an axis that is substantially parallel to an axis about which the toilet seat pivots when moved between the lowered position and the raised position; that the fluid-based movement source includes a housing having a fluid inlet to receive a fluid, a fluid outlet to expend the fluid, and a first channel that connects the fluid inlet to the fluid outlet, and at least a portion of the movement transmission mechanism is situated within the channel to be moved by a flow of the fluid flowing through the fluid-based movement source when actuated; that the movement transmission mechanism includes a piston and a seat coupling device connected via a link; that the link is one of a cable, a belt, and a chain or a similar component; that the movement transmission mechanism further includes a pulley, the piston being connected to the pulley via the link, and the seat coupling device being adjustably fixable to the pulley; that the fluid-based movement source includes an adjustable regulator to regulate a flow-rate of the fluid, and thereby the amount of force generated by the fluid-based movement source; that the fluid inlet is connectable to a pressurized residential or commercial water supply to receive the fluid and the fluid outlet is connectable to the toilet to provide the fluid to the toilet bowl; that, in the raised position, the movement transmission mechanism is configured to receive a triggering movement from the seat to initiate a lowering movement of the movement transmission mechanism to lower the toilet seat from the raised position to the lowered position, the lowering movement of the movement transmission mechanism being resisted by a fluid contained within the fluid-based movement source to lower the toilet seat from the raised position to the lowered position in a controlled manner; a mounting bracket for attaching the fluid-based movement source to an edge of the toilet bowl proximate a hinge of the toilet seat on either side of the toilet seat; and that the mounting bracket is attachable to the toilet bowl via one or more connection points for the toilet seat.

In general, another innovative aspect of the subject matter described in this disclosure may be embodied in a toilet flushing system that includes a fluid regulation component configured to regulate an amount of fluid used by the toilet flushing system during a flush cycle to flush a toilet. The toilet flushing system includes a position unit coupleable to a toilet seat of the toilet and configured to detect whether the toilet seat is in a raised position or a lowered position. The position unit is coupled to the fluid regulation component to provide a signal indicating whether the toilet seat is in the raised position or the lowered position. The fluid regulation component is further configured to regulate the amount of fluid used during the flush cycle based at least in part on the signal.

The system and other embodiments may each optionally include one or more of the following features. For instance, the system may include: that the position unit includes a position detector that is configured to connect the fluid regulation component to the toilet seat and transmit the position of the toilet seat to the fluid regulation component; that the fluid regulation component is included in one of the position unit and a flush valve of the toilet; that the position unit includes a fluid regulation chamber and the fluid regulation component is a valve situated in the fluid regulation chamber to control the amount of fluid that passes through the chamber during a flush cycle; and a toilet seat raising and lowering device for raising and lowering the toilet seat, the position unit being included in the toilet seat raising and lowering device and including a sensor for sensing a position of the toilet seat.

Other embodiments of one or more of these aspects include corresponding systems, devices, and methods.

BRIEF DESCRIPTION OF THE DRAWINGS

The present disclosure is illustrated by way of example, and not by way of limitation in the figures of the accompanying drawings in which like reference numerals are used to refer to similar elements.

DETAILED DESCRIPTION

Figure 1A:
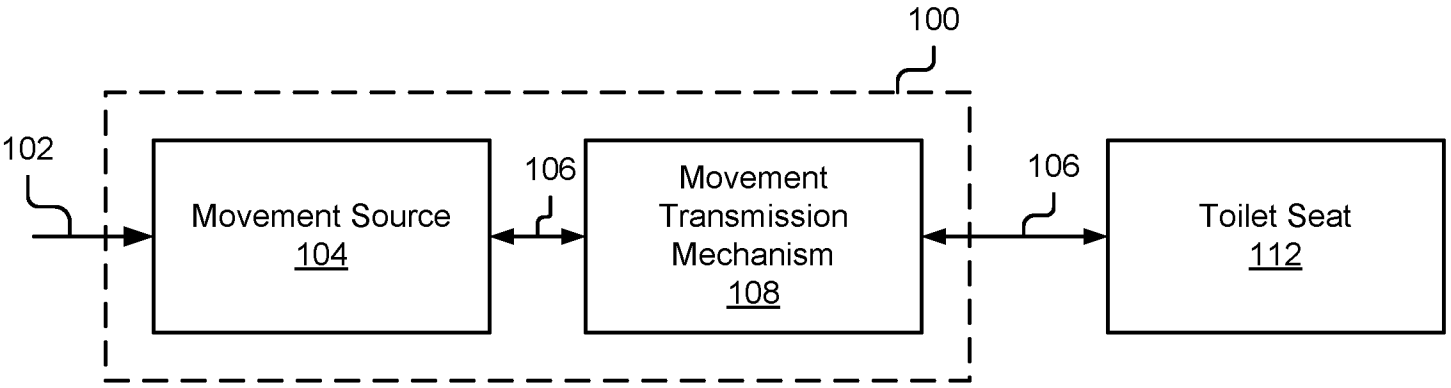
FIGS. 1A and 1B are block diagrams of an example toilet seat raising and lowering device.
Figure 1B:
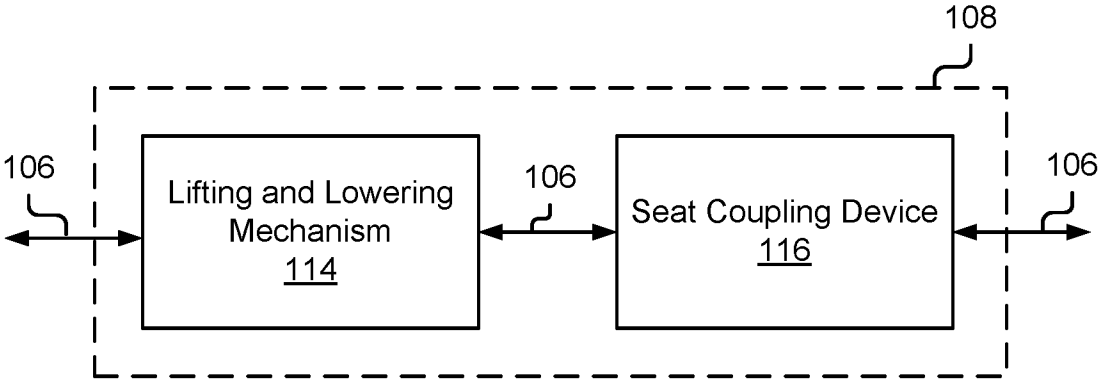

FIGS. 1A-B are block diagrams of example toilet seat raising and lowering device 100. In particular, FIG. 1A is a block diagram of the example toilet seat raising and lowering device 100 that includes a movement source 104, a movement transmission mechanism 108, and a toilet seat 112. The toilet seat 112 is coupled to a toilet (not shown) having a toilet bowl and can be raised from a lowered position to a raised position and lowered from the raised position to the lowered position. In some embodiments, the toilet seat 112 is pivotably connected to the toilet to move between the raised and lowered positions. In the lowered position, the toilet seat 112 may come in contact with and be situated substantially parallel to a top surface of the toilet bowl, and in the raised position, may be substantially perpendicular to the top surface of the toilet bowl. The toilet seat 112 may have a variety of shapes or sizes depending on the configuration of the toilet. For instance, the toilet seat 112 may be flat, contoured for comfort, round, elongated, padded, heated, have an open front, include contact elements situated on a toilet-bowl facing surface for contact with the toilet bowl when in a lowered position, may or may not be accompanied by a lid that is hinged for closure when the toilet is not in use, etc. The toilet seat 112 may be made of any material or combination of materials, including plastic, wood, metal, etc.

The movement source 104 is a device for generating force to automatically raise the toilet seat from a lowered position to a raised position. The movement source 104 can generate force based on an input 102. In some embodiments, the movement source 104 may receive the input 102 to raise the toilet seat 112 responsive to the toilet being flushed. For instance, in a fluid-based embodiment, the opening of a flush valve of the toilet (not shown) may flow fluid through the movement source 104, which is converted by the movement source 104 into force 106 that is transferred by the movement transmission mechanism 108 to the toilet seat 112 to raise it from a lowered position to a raised position. In another example, the movement source 104 may be electrically-based (e.g., an electric motor) and may receive an electrical input signal signaling it to generate force 106 to raise the toilet seat 112 when the toilet is flushed.

The input 102 can be any form of energy (e.g., kinetic, electrical, thermal, potential, electromagnetic, electrochemical, etc.) that the movement source 104 can convert into force 106. For example, the input 102 may be one or more of a fluid flow and/or fluid pressure (e.g., hydraulic, pneumatic, etc.), an electric current, heat transfer, mass and/or velocity of a physical object (e.g., gear assembly, kinematic assembly, etc.), a combination of the foregoing, etc. In a further example, the movement source 104 may be a fluid-based actuator, such as the actuator 104A discussed below with reference to FIGS. 2A-4D, and may convert a fluid flow/pressure differential into the movement. Further non-limiting examples of a movement source 102 include an electric motor, a pneumatic actuator, a hydraulic actuator, a relay, a spring, a counterweight, one or more gears, a combustion or thermal-based engine, etc., that can be used to generate the movement.

For instance, an example embodiment of a torsion-based seat raising and lowering device 100 may include a tension spring assembly, a dampener assembly, and a clasp assembly as a movement source 104, a lever as a movement transmission mechanism 108, and a mounting bracket. The lever may be coupled to the mounting bracket for rotation about the longitudinal axis of the mounting bracket. The mounting bracket can attach the device proximate the toilet bowl, such as the edge of a toilet bowl proximate the rear side where the toilet seat is mounted to the toilet bowl. The lever may be configured to pivot at a base in a rotational plane parallel to that of the toilet seat and apply pressure to the toilet seat to automatically articulate the toilet seat to a raised position by force from a tension spring assembly enclosed in the base. The toilet seat lid may be articulated alone or with its lid. The device may include a clasp assembly component for retaining the toilet seat in the lowered position when first lowered until subsequent pressure is applied to the toilet seat and then removed such as where a patron sits on the toilet seat and then rises.

An example embodiment of a counter-weight-based seat raising and lowering device 100 may include a fluid-based actuator as a movement source 104 and, as a transmission mechanism 108, may include a counter-weight mechanism held by a latch and a lever arm connected to the counter-weight mechanism. The fluid based actuator may include an inlet and outlet substantially similar to the actuator 104*a*, where, upon opening of the flush valve of the toilet, the fluid flow through the actuator can trigger the latch, thus releasing the counter-weight mechanism, which moves along a predetermined path to move the lever arm to raise the toilet seat to the raised position. In an alternative example, the movement source 104 may be electric and may be triggered by an electric signal provided by the flush valve of the toilet when the flush valve has been triggered or opened. It should be understood that numerous other variations and embodiments are also possible, contemplated and within the scope of the present disclosure.

The movement source 104 may, in some embodiments, include a regulator to control or regulate the amount of force applied to the toilet seat 112 to raise or lower it. For example, in an embodiment where the movement source 104 is fluid-based, the movement source 104 may include one or more of a pressure-reduction chamber, a bleed valve, a throttle valve, a reduction valve, a tube with adjustable inlet and outlet orifices, and the like to adapt the force 106 (e.g., pressure) being applied to the movement transmission mechanism 108.

The movement transmission mechanism 108 is a mechanism for transmitting/transferring/exerting the force 106 generated by the movement source 104 to the toilet seat 112 to raise it. In some embodiments, the movement transmission mechanism 108 includes a mechanical device or assembly that is coupled to the movement source 104 to receive the force/movement 106 generated thereby and connected to the toilet seat 112 to transmit the force 106 to the toilet seat 112 to raise it.

The movement transmission mechanism 108 can convert, reduce, or otherwise alter the force 106 (e.g., movement) being transmitted to raise the toilet seat 112 in a controlled manner. For instance, the movement transmission mechanism 108 may adapt the force 106 being applied to the toilet seat 112 so it does not slam into the other components of the toilet, such as a tank or a pipe, when raised.

When lowering the toilet seat 112, the movement transmission mechanism 108, in cooperation with the movement source 104, can also adapt the force 106 being applied to the toilet seat 112 to prevent it from slamming onto the toilet bowl. The closure of the toilet seat 112 may be controlled by a relatively weaker counter-force simultaneously applied to the movement transmission mechanism 108 by the movement source 104. In some embodiments, the counter force is resistance created by the movement source 104 when operated in reverse by the movement transmission mechanism 108 using the force produced by the lowering of the toilet seat 112 (e.g., the acceleration of the toilet seat produced by gravity during lowering of the toilet seat 112).

FIG. 1B depicts a block diagram of an example movement transmission mechanism 108. As depicted, the movement transmission mechanism 108 may further include a lifting and lowering mechanism 114 and a seat coupling device 116 coupled together to provide the functionality of the movement transmission mechanism 108. In some embodiments, the lifting and lowering mechanism 114 and the seat coupling device 116 may be integrated into a single component or set of components. In other embodiments, the lifting and lower mechanism 114 may be connected. For instance, the lifting and lowering mechanism 114 and the seat coupling device 116 may be fastened together using a fastener, attached via a detachable or permanent coupling, and the like. In any of the forgoing embodiments, the lifting and lowering mechanism 114 and the seat coupling device 116 are attached in such a way that force 106 (e.g., movement) may be transmitted between the movement source 104 and the toilet seat 112 to raise and lower it.

The lifting and lowering mechanism 114 may be connected to the movement source 104 to receive the force 106 generated by the movement source 104 and transmit the force 106 to the seat coupling device 116, which then applies the force 106 to the toilet seat 112 to raise it. As a further example, the lifting and lowering mechanism 114 may be pushed along a predetermined trajectory by a pressurized fluid flowing through the movement source 104, and in turn, may pivot the seat coupling device 116 from a lowered position to a raised position to raise the toilet seat 112. In some embodiments, the lifting and lowering mechanism 114 may include the cable and piston assembly 114*a* discussed below with reference to at least FIGS. 3 and 4D.

The seat coupling device 116 is a device for coupling with and lifting and lowering the toilet seat 112. In some embodiments, the seat coupling device 116 may be positioned in a manner that allows it to contact a surface of the toilet seat 112 that faces the toilet bowl when lowered and to raise the toilet seat 112 into the raised position. The seat coupling device 116 may be adjustable to accommodate any configuration of toilet or toilet seat. In some embodiments, a proximal end of the seat coupling device 116 may be connected to a distal end of the lifting and lowering mechanism 114, and a distal end of the seat coupling device 116 may interface with the toilet seat 112 to raise and lower it using the force 106 transmitted to the seat coupling device 116 by the seat coupling mechanism 114.

The seat coupling device 116 may have numerous different configurations. For instance, the seat coupling device 116 may couple to the toilet seat 112 by coming in and out of contact with one or more surfaces of the toilet seat 112, the seat coupling device 116 may be integrated with the toilet seat 112 and connect to the lifting and lowering mechanism 114 to receive and transmit force 106 (e.g. movement), the seat coupling device 116 may include one or more couplings and/or fasteners and may detachably couple the lifting and lowering mechanism 114 to the toilet seat 112, etc. A further example of the seat coupling device 116 may include the lever arm 116*a* discussed in further detail below. In other embodiments, the seat coupling device 116 may be eliminated and the lifting and lowering mechanism 114 may be integrated with the toilet seat 112.

In some embodiments, the intensity and/or speed used to raise or lower the toilet seat 112 may depend upon the net amount of pressure or force 106 that is transmitted via the movement transmission mechanism 108 between the toilet seat 112 and the movement source 104. If the net amount of force 106 is high, then the movement transmission mechanism 108 may lift or close the toilet seat 112 quickly. Conversely, if the amount of force 106 is low, the movement transmission mechanism 108 may raise or lower the toilet seat 112 slowly. In some embodiments, the magnitude and/or direction of the force 106 may be adapted as discussed elsewhere herein. In these or other embodiments, the movement transmission mechanism 108, such as the lifting and lowering mechanism 114 and/or the seat coupling device 116 may include force regulation components, such as regulators, springs, counter-weights, resistance elements such as grommets, washers, and the like, to adjust the force 106 being using used to raise or lower the toilet seat 112.

Figure 2A:
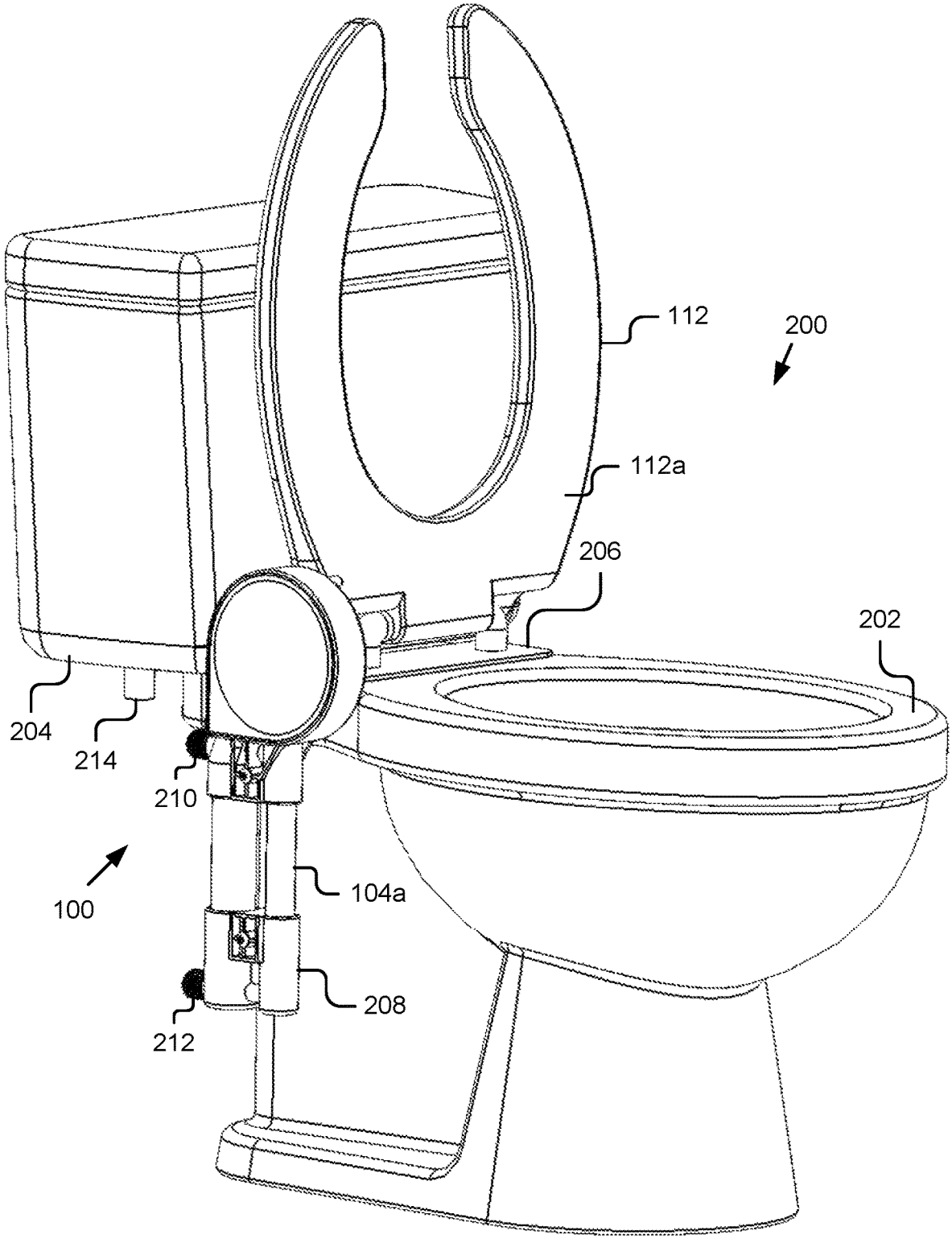
FIGS. 2A-2D are perspective views of example toilets equipped with an example toilet seat raising and lowering device.
Figure 2B:
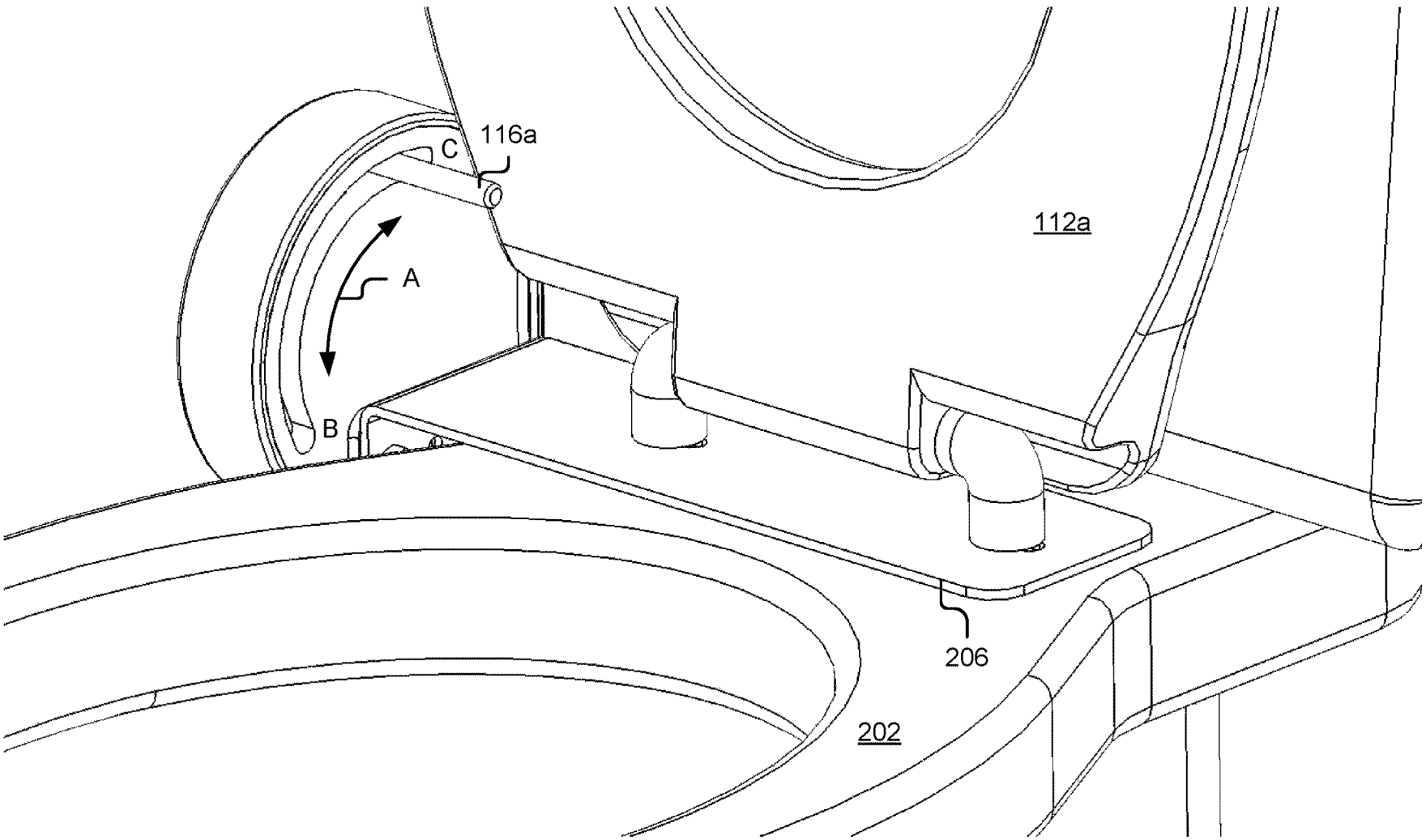

FIGS. 2A and B are perspective views of an example toilet 200. In particular, FIGS. 2A and B collectively show a toilet 200 including a toilet bowl 202, the toilet seat 112, a tank 204, and an example toilet seat raising and lowering device 100. The seat raising and lowering device 100 depicted in FIGS. 2A and 2B includes a mounting bracket 206 attached stationary to an example instance of a movement source 104 termed an actuator 104*a*. In some embodiments, the mounting bracket 206 may be attached to the actuator 104*a* using any suitable fastening means, such as fasteners, welds, and the like. In other embodiments, the mounting bracket 206 may be integrated with the actuator 104*a* or the actuator 104*a* may attach directly to and/or be integrated into the toilet bowl 202, the toilet seat 112, or the tank 204 without the use of the mounting bracket 206.

In the depicted embodiment, the mounting bracket 206 attaches to the toilet bowl 202 in between the toilet seat 112 and the toilet bowl 202. More particularly, the mounting bracket 206 can be configured to attach to the toilet 200 via one or more mounting points used to attach the toilet seat 112 to the toilet 200. In some embodiments, the mounting bracket 206 may be about four to six inches long and about 1 to 2 inches wide and include two holes or u-shaped slots about four to six inches apart where the mounting bracket 206 can be attached to the toilet bowl 202 via the connection points and/or fasteners that connect the toilet seat 112 to the toilet 200. In other embodiments, the mounting bracket 206 may be configured to connect to another component of the toilet 200, such as the tank 204, an underside surface of the toilet bowl 202, the toilet seat 112, or the like.

The lever arm 116*a* can attach to the actuator 104*a* and extend out from a housing 208 of the actuator 104*a* along a surface 112*a* of the toilet seat 112. The lever arm 116*a* can be attached to the actuator 104*a* in a fashion allowing the lever arm 116*a* to contact the toilet seat 112 and move between a lowered position B and a raised position C as indicated by arrow A. In some embodiments, the lever arm 116*a* ranges from about one to six inches long and an eighth to a half inch wide and extends from the actuator 104*a* so that it may run adjacent to, and may come in contact with, the toilet seat 112. In some embodiments, the lever arm 116*a* may be j-shaped and may be inserted into two holes 117 of the pulley 218 for additional strength and rigidity when pressing against the toilet seat to raise or lower it, as depicted in FIG. 4D. In some embodiments, the lever arm 116*a* may be u-shaped (not shown) and may be inserted into two or more holes 117 of the pulley 218 and extend adjacent to the toilet seat 112 to provide additional rigidity and strength when pressing against the toilet seat 112 to raise or lower it. However, while the above embodiments are provided, it should be understood that the lever arm 116*a* may have numerous different configurations. For example, the lever arm 116*a* may be or include a fastener that connects the actuator cable and piston assembly 114*a* depicted in FIG. 3 to the toilet seat 112. Further, in some embodiments, the lever arm 116*a* may be eliminated or integrated into the toilet seat 112.

The toilet seat 112 can be pivotably fastened to the toilet bowl 202 and may pivot (e.g., about a hinge) to positions C and B, respectively. In some embodiments, to raise the toilet seat 112 from position B to position C, the lever arm 116*a*, upon actuation, pivots in a rotational plane from position B to position C, thereby pressing against surface 112*a* of the toilet seat 112 and pivoting the toilet seat 112 about a pivot point (e.g., hinge) from position B to position C. Conversely, to lower the toilet seat 112 from position C to position B, upon actuation, the surface 112*a* of the toilet seat 112 rests against the lever arm 116*a* as it pivots in the rotational plane from position C to B, which slows the toilet seat 112's movement sufficiently to prevent it from slamming against the toilet bowl 202, thus achieving a soft close.

While not depicted, in some embodiments, the lever arm 116*a* includes a tip, such as a wheel rotatably attached to the lever arm 116*a* at the distal end and configured to come into contact with and roll along the surface 112*a* when raising and lowering the toilet seat 112. This is advantageous as it can reduce abrasions to the surface 112*a* of the toilet seat 112 caused by the lever arm 116*a* coming into contact with and rubbing against the toilet seat 112 during actuation. The lever arm 116*a* and its actuation are discussed in further detail below with reference to at least FIG. 3.

Figure 3:
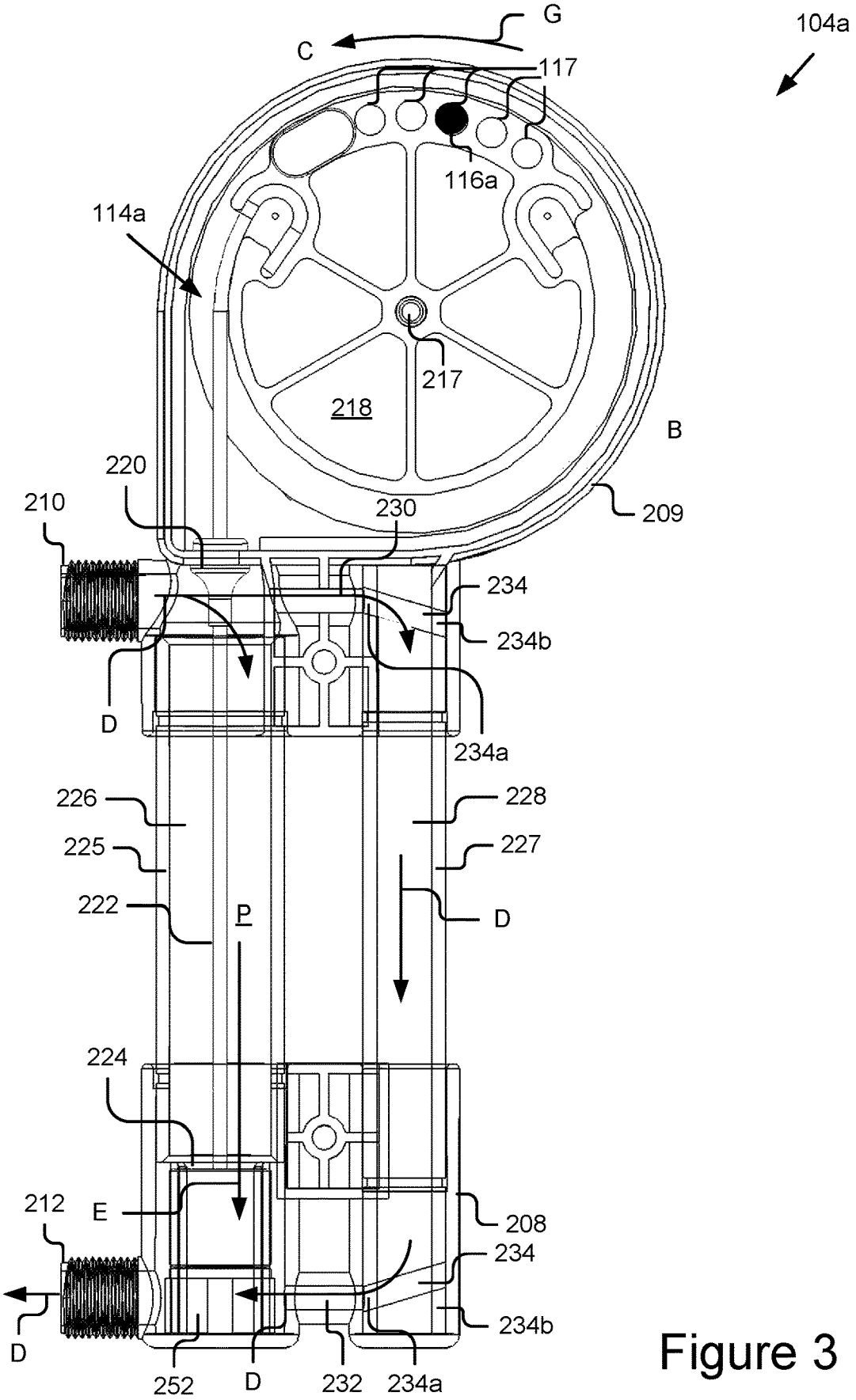
FIG. 3 is a front cross-sectional view showing the internal components of an example toilet seat raising and lowering device.
Figure 4A:
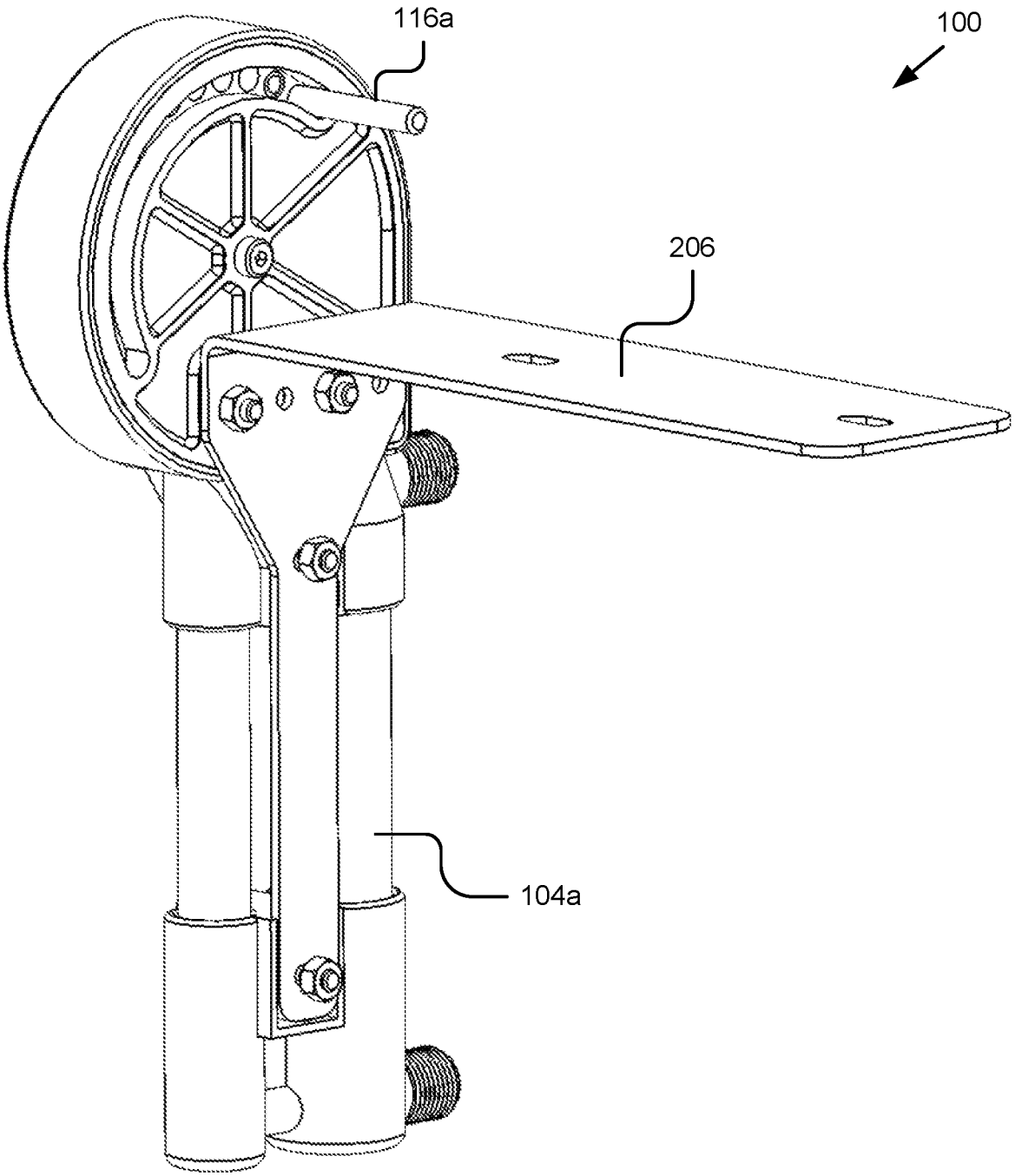
FIGS. 4A-4D are top perspective, bottom perspective, left, and exploded views of an example toilet seat raising and lowering device.
Figure 4B:
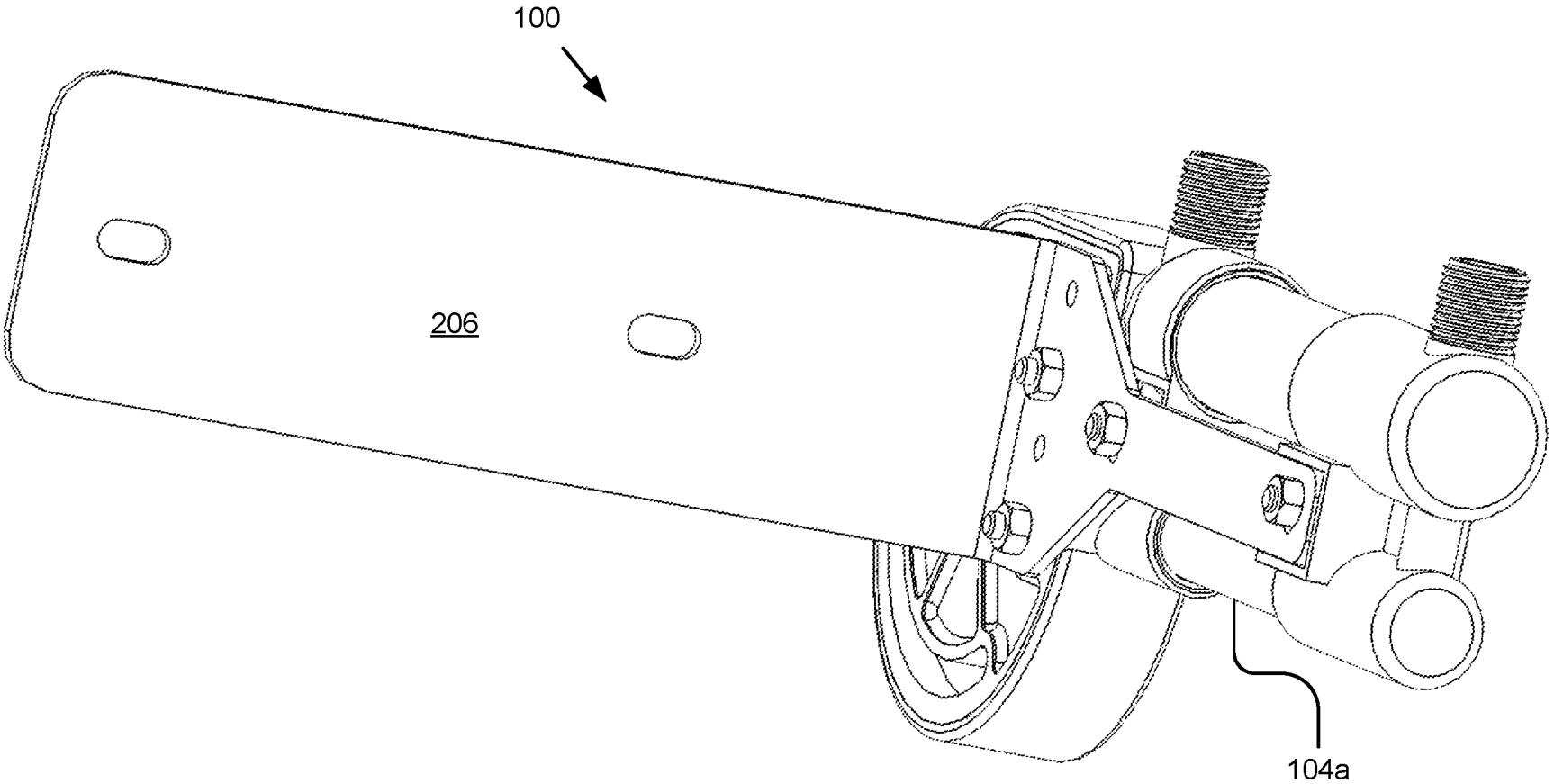
Figure 4C:
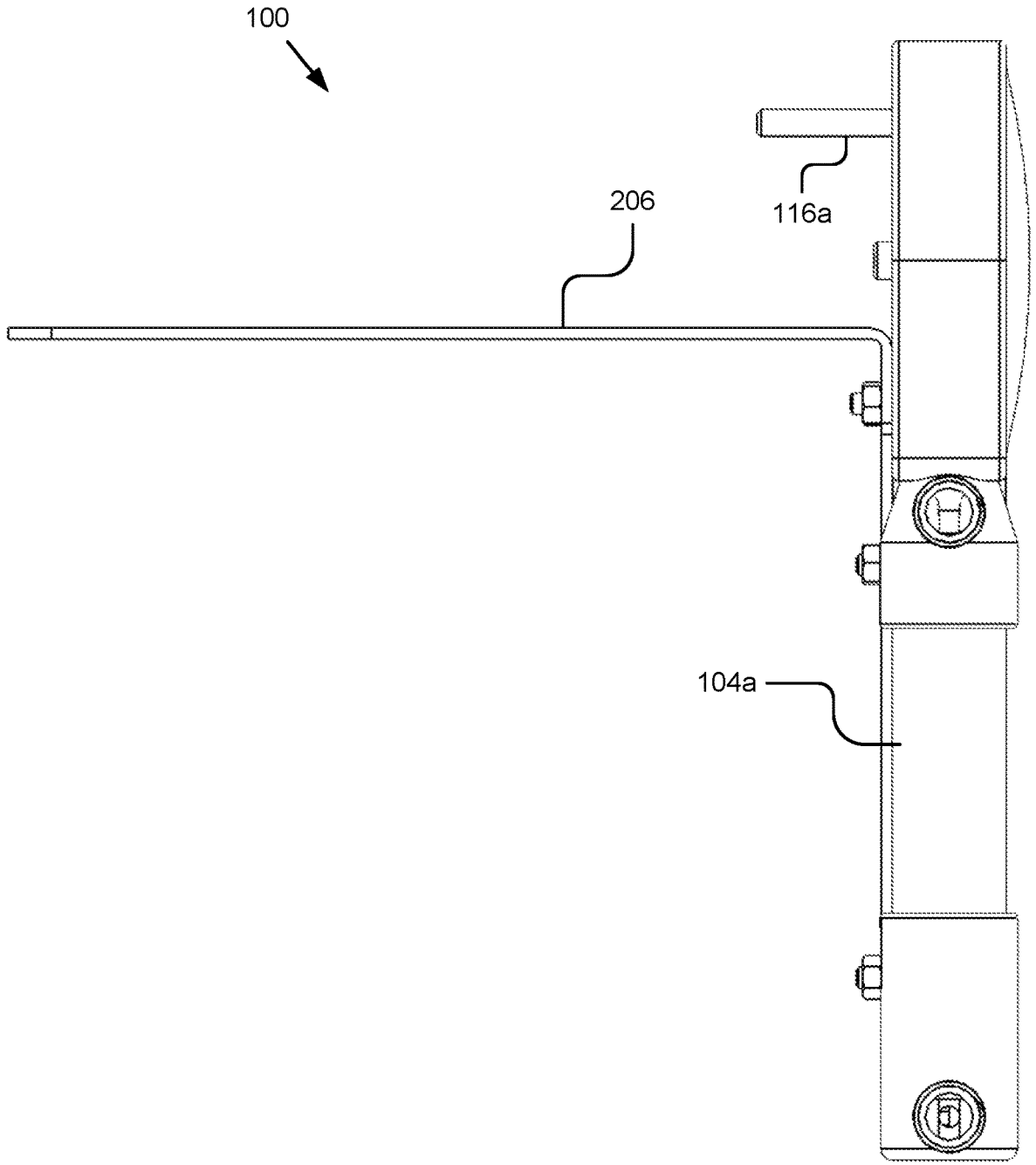
Figure 4D:
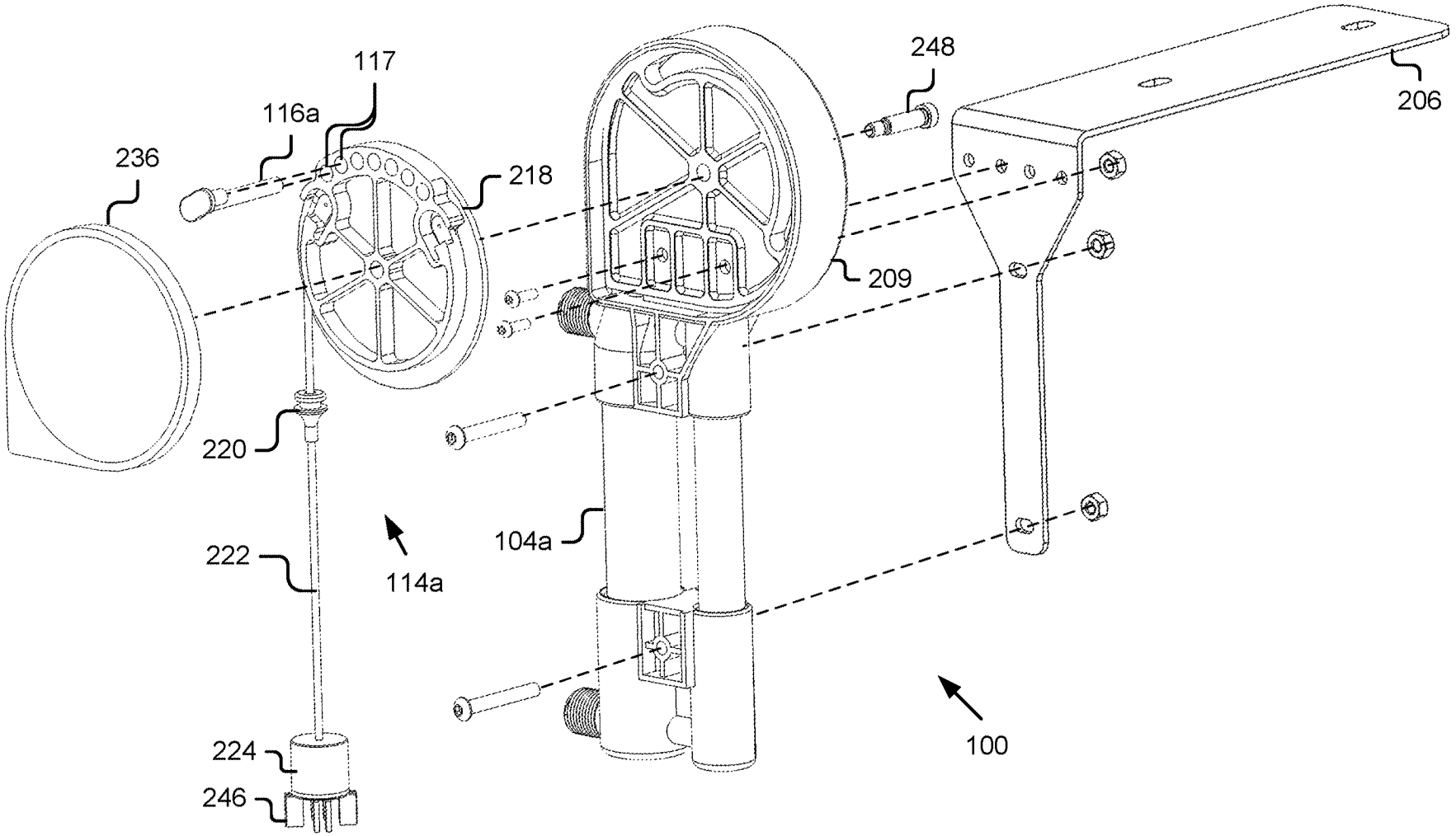

FIG. 3 is a front cross-sectional view of an example actuator 104*a*. As depicted, the actuator 104*a* includes a bottom housing 208, a top housing 209, a piston housing 225, and a regulation portion 227, which are assembled together in a fluid-tight manner. For example, the piston housing 225 and the regulation portion 227 may be tubular in shape and are fitted in a fluid-tight manner into corresponding receiving portions of the top housing 209 and the bottom housing 208. The bottom housing 208, top housing 209, and the piston housing 225 may cooperatively contain a cable and piston assembly 114*a* that forces the lever arm 116*a* to move as a result of pressurized fluid flowing through an inlet and outlet and pressing against the cable and piston assembly 114*a*. In some embodiments, the piston housing 225 may contain a piston chamber 226 and the regulation portion 227 may contain a regulation chamber 228. The top housing 209 may include an inlet 210, which connects to an inlet end of the piston chamber 226 and provides pressurized fluid into the piston chamber 226, and the bottom housing 208 may include an outlet 212, which connects to an outlet end of the piston chamber 226 and allows fluid to exit the actuator 104*a*. The piston chamber 226 and regulation chamber 228 may be connected at an inlet end via a connection pipe 230 and at an outlet end via a connection pipe 232. The regulation portion 227 is configured to adjustably regulate the flow-rate through the regulation chamber 228 and thus the pressure P in the piston chamber 226, as discussed in further detail below.

In the depicted embodiments, the housing 208 of the actuator 104*a* is injection molded using a polymer (e.g., thermoplastic, thermosetting plastic, elastomer, etc.) and is designed to have wall-thicknesses sufficient to withstand fluid pressures exceeding 100 psi. This is advantageous as it reduces the cost of the toilet seat raising and lowering device 100 while producing a toilet seat raising and lowering device 100 that is able to withstand fluid pressures that occur in residential and commercial applications, thus making the toilet seat raising and lowering device 100 well suited for use in a retrofit application on existing toilets 202 and toilet seat 112 assemblies. However, it should be understood that the housing 208 may be formed of any suitable materials (e.g., metal, wood, ceramic, composites, etc.) using any type of suitable manufacturing processes, including one or more of stamped, milled, cast, molded, etc. Moreover, while the actuator 104*a* is depicted as being made of distinct components, in these or other embodiments, the actuator 104*a* may be formed of a single component.

The cable and piston assembly 114*a* includes a pulley 218, a cable 222, and a piston 224. As depicted, the pulley 218 is attached to one end of the cable 222 along an outer rim and is rotatably mounted to the housing 208 about a center axis. For example, as depicted in FIG. 4D, the pulley 218 may be mounted to an axle 248 insertable into the top housing 209. Further, the pulley 218 may be mounted to the axle 248 using a friction element that regulates the amount of force needed to rotate the pulley 218. For example, a rubber grommet (not shown) may be inserted at a connection point between the pulley 218 and the axle 248 to increase the friction produced when rotating the pulley 218 around the axle 248.

As depicted, the piston 224 is attached to the other end of the cable 222. The cable 222 passes through an aperture of a seal 220, such as an NPT O-ring plug, included in the top housing 209. The seal 220 is situated between the pulley 218 and the piston 224 at the inlet end 210 of the piston chamber 226 and provides a fluid-tight seal between the cable 222 and the piston chamber 226 that can withstand high fluid pressures of substantially 100 psi or so and can prevent the fluid to leak out of the piston chamber 226. The piston 224 is situated inside the piston chamber 226 and can slide along and form a circumferential seal therewith. In the depicted embodiment, the piston chamber 226, the regulation chamber 228, and the piston 224 are cylindrical in shape. However, it should be understood that these components may take other shapes and forms without departing from the scope of the present disclosure.

The lever arm 116*a* may be attached to the pulley 218 and rotate around the central axis 217 of the pulley 218 when the pulley 218 rotates. The pulley 218 may include a series of insertion points to receive and secure the lever arm 116*a*. This allows the lever arm 116*a* to be adjustably positioned to accommodate various different toilet and toilet seat configurations. For example, as depicted in FIG. 3, the lever arm 116*a* may be inserted into the third of five insertion points 117 to accommodate an average-configured toilet seat. However, if the toilet 200 is instead equipped with toilet seat 112 with a larger gap between the toilet seat 112 and the toilet 200, the lever arm 116*a* can be moved to a fourth, fifth, etc. insertion point 117 (from the left) to accommodate the larger gap or conversely the lever arm 116*a* can be moved to a first or second insertion point 117 to accommodate a smaller gap between the toilet seat 112 and the toilet 200. In another example, the lever arm 116*a* may be u-shaped and have two ends inserted into two insertion points 117, respectively (either directly adjacent or with one or more insertion points 117 spaced in-between). In yet another embodiment, where the lever arm 116*a* is eliminated or built into the toilet seat 112, the various insertion points 117 in the pulley 218 may not be required and/or the pulley 218 may take other forms or be replaced by an equivalent component configured to pivot the toilet seat 112 between the lowered position and the raised position.

In the depicted embodiment, the actuator 104*a* can actuate the lever arm 116*a* to raise the toilet seat 112 as follows. When the toilet seat 112 is located in the lowered position B, the lever arm 116*a* is also in the lowered position B on an underside surface 112*a* of the toilet seat 112, which further situates the piston 224 near the inlet end of the piston chamber 226. A pressure differential between the inlet 210 and the outlet 212, which can be created by the toilet 200 being flushed, causes fluid to enter through inlet 210 and flow through the chambers 226 and 228 of the actuator 104*a*, as illustrated by arrows D. By way of further illustration, in some embodiments, when the toilet 200 is flushed, water stored in the tank 204 (e.g., see FIG. 2A) is released by a flush valve (not shown) into the bowl 202. The tank 204 is then replenished via a fill valve (not shown) located in the tank 204 with fluid (e.g., water) supplied via inlet 214 (e.g., see FIG. 2A). The inlet 210 is connected via a fluid line to the outlet 212 and the inlet 210 is connected to a pressurized fluid supply line (not shown). As such, when the flush valve is opened, fluid (e.g., water) flows through the actuator 104*a* thereby raising the toilet seat 112 as described above.

Figure 2C:
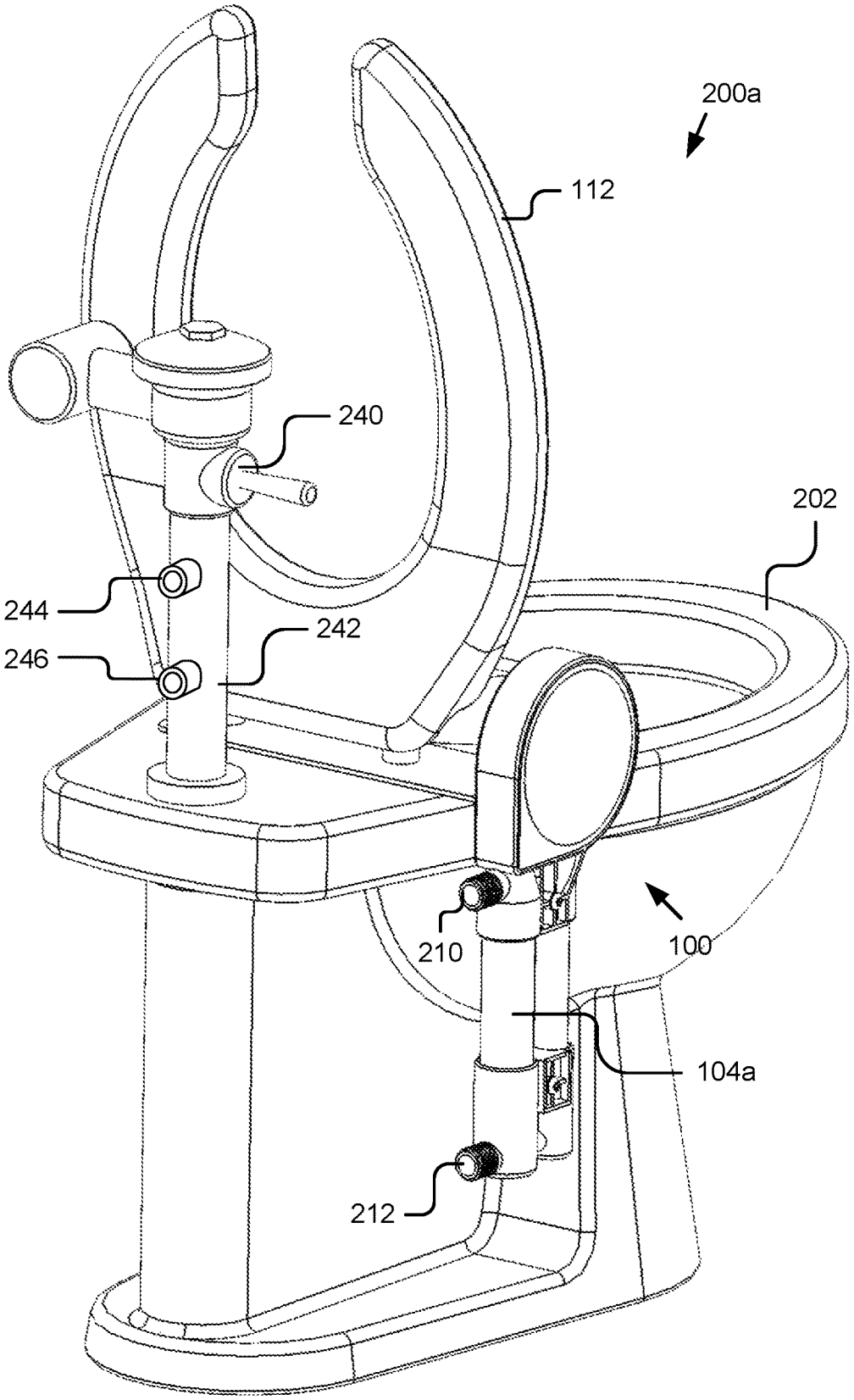
Figure 2D:
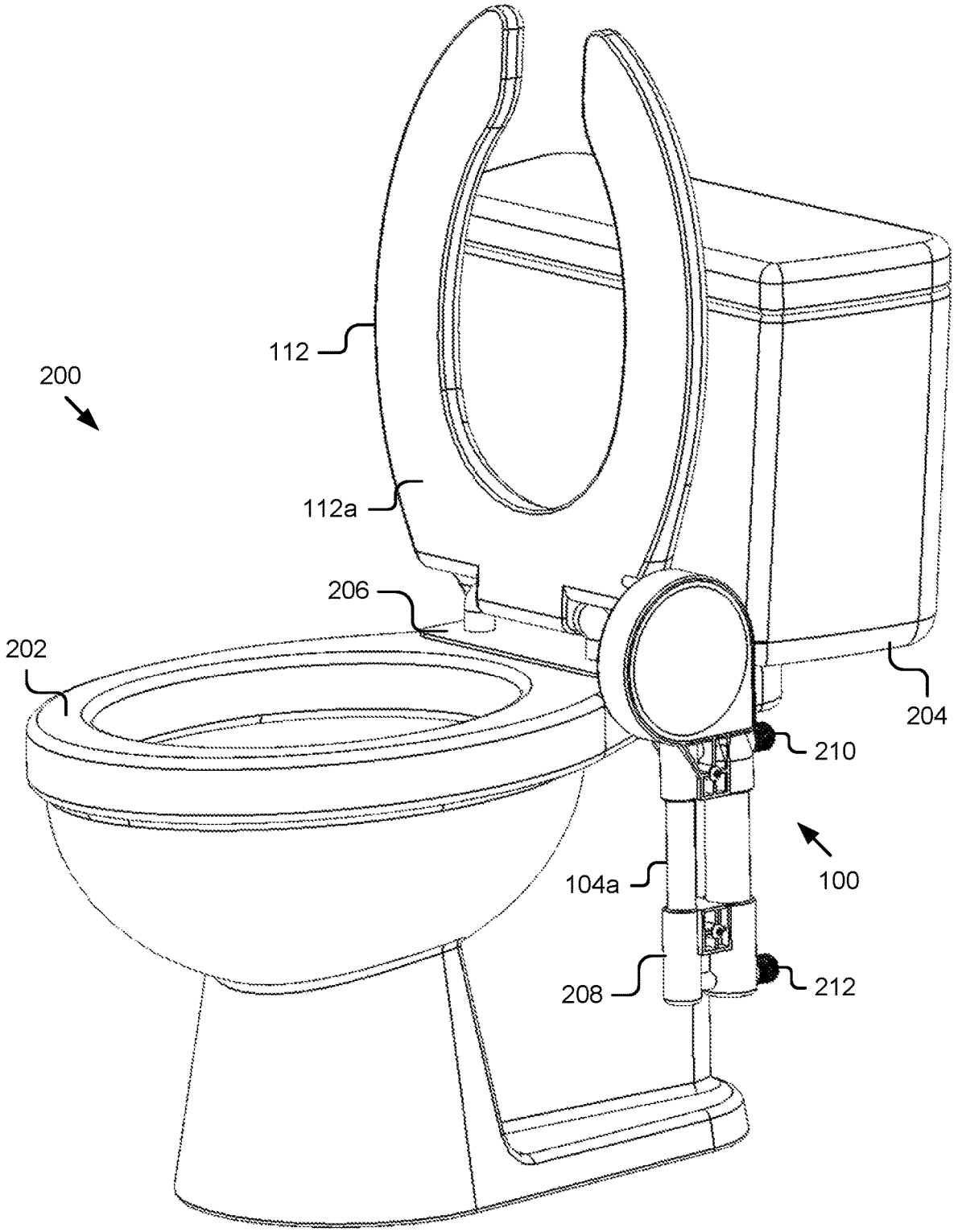

While some embodiments provided herein are described within the context of a toilet 200 equipped with a tank 204, it should be understood that the seat raising and lowering device 100 is applicable to any type of toilet design including, for example, a tankless toilet. For instance, the seat raising and lower device 100 may be attached to a commercial toilet 200*a* that lacks a tank, as depicted in FIG. 2C, and instead uses a flush valve 240 to gush a stream of fluid under high-pressure into the toilet bowl 202 to flush it. With further reference to FIG. 2C, a vertical pipe 242 is situated between the flush valve 240 and the toilet bowl 202, and includes a fluid supply nipple 244 and a fluid return nipple 246, which are situated in-line (e.g., upstream or downstream of) with the flush valve 240. The fluid supply nipple 244 is connected via a fluid supply line (not shown) to the inlet 210 of the actuator 104*a* and the outlet 212 is connected via a fluid return line (not shown) to the fluid return nipple 246. When the toilet 200*a* is flushed by opening the flush valve 240, pressurized fluid flows from fluid supply nipple 244 and supply line through the actuator 104*a* and back to the pipe 242 via the fluid return line and fluid return nipple 246, thereby raising the toilet seat 112 as described above. The operation of the toilet seat 112 slow close is the same for a tankless toilet 200*a* as described herein in another embodiment of a toilet with a tank 204.

The fluid flow through the actuator 104*a* increases the pressure P inside the piston chamber 226, which moves the piston 224 downward as illustrated by arrow E. The downward movement of the piston 224 pulls the cable 222 downward through the seal 220 and rotates the pulley 218 in a counter-clockwise direction, as illustrated by arrow G. This counter-clockwise rotation presses the lever arm 116*a* against the toilet seat 112 and lifts it from the lowered position B to the raised position C. The bottom housing 208 may include a rest 252 which may stop the downward movement of the piston 224. In this position, the pulley 218 and lever arm 116*a* cease rotating (provided they already haven't ceased rotating by the toilet seat 112 having reached the raised position). The rest 252 includes one or more through apertures configured to allow the fluid to flow freely from the connection pipe 232 to and through the outlet 212 (and thus through the actuator 104*a*) until the tank 204 has been replenished (and its fill valve (not shown) closes) or the fill valve 240 of the tankless toilet 200*a* closes. As the fluid flow ceases, the pressure at the inlet 210 and outlet 212 equalizes, thus equalizing the pressure P within the chambers of the actuator 104*a*.

The amount of pressure P that is generated within the piston chamber 226 when actuating the lever arm 116*a* can be regulated via the regulation portion 227 to control how much force is applied to raise the toilet seat 112. This is advantageous because it can prevent the toilet seat 112 from slamming into the tank 204 or stressing the hinges when raised by the lever arm 116*a*, and thereby can reduce wear and tear and maintenance costs. It also allows the seat-lifting device 100 to be customized to satisfy the requirements of a variety of different toilet seat designs, as some toilets have seats that are light and open with little force, and other toilets have seats that are heavier and require more force to open.

The regulation portion 227 may include one or more regulators 234 for regulating the flow-rate of the fluid. In the depicted embodiment, the regulators 234 are two angled slots formed in the sidewall of the regulation portion 227 at locations adjacent to the connection pipes 230 and 232, respectively. In this configuration, the regulation portion 227 is adapted to twist in place to change how the angled slots 234 align with the connection pipes 230 and 232. This change in alignment changes the size of the openings connecting the chamber 228 to the connection pipes 230 and 232, and thus increases or decreases the flow-rate of the fluid passing through the regulation portion 227, and by extension, the actuator 104*a* generally. For example, a maximum flow-rate can be achieved by twisting the regulation portion/tube 227 to a position where outermost portions 234*a* of the slots 234 are aligned with the connection pipes 230 and 232, respectively. Conversely, a minimum flow-rate can be achieved by twisting the tube 227 to a position where the innermost portions 234*b* are facing the connection pipes 230 and 232, respectively. Further, a nearly infinite number of intermediate flow-rates may be achieved by twisting the tube 227 such that an intermediate portion of the angled slots 234 interface with the connection pipes 230 and 232, respectively.

Figure 8:
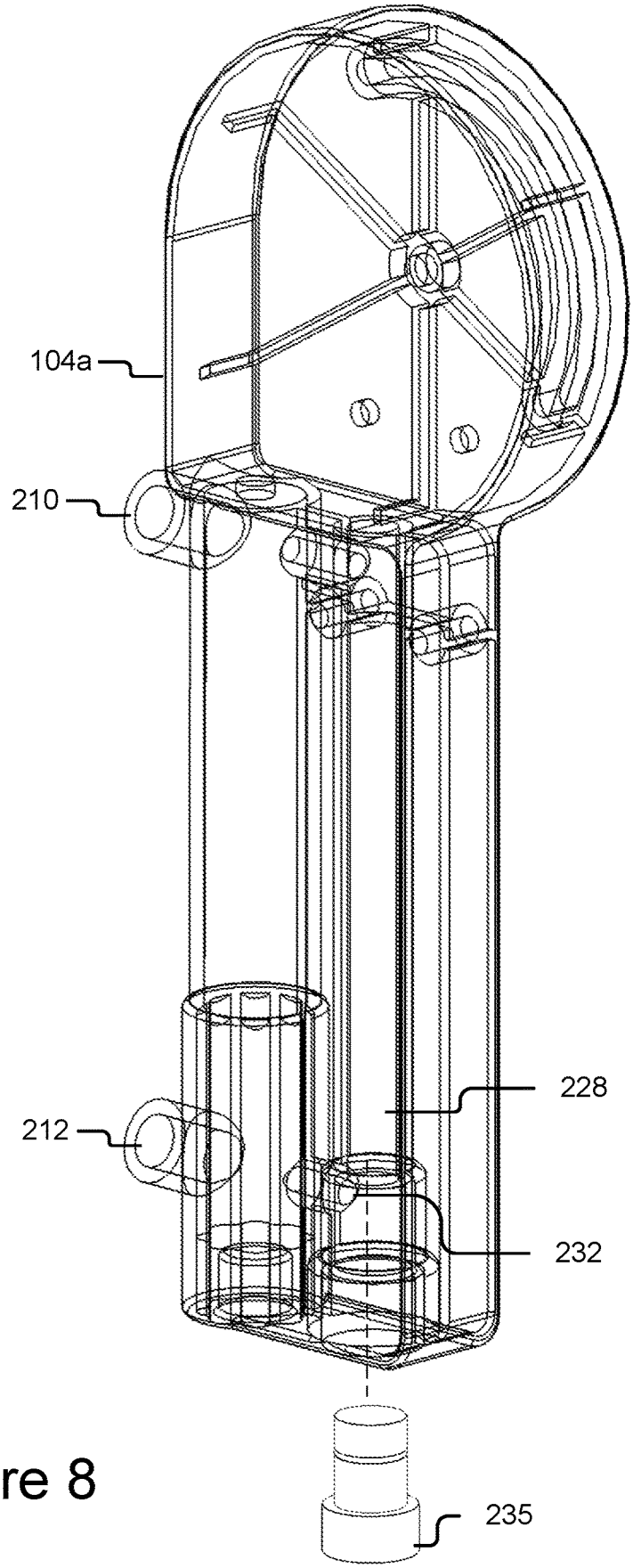
FIG. 8 is an exploded view of an example toilet seat raising and lowering device that includes a fastenable regulation device.

In other embodiments, the regulator 234 may be or include an adjustable bleed screw 235 that is insertable into the outlet end of a regulation chamber 228 to restrict flow through the regulation chamber 228 by blocking an orifice leading to the connection pipe 232 and the outlet 212, as depicted by FIG. 8. In some embodiments, the insertion depth of the screw 235, and thus, the amount by which the screw 235 restricts fluid flow through the regulation chamber 228, can be adjusted by inserting a compatible tool (not shown) into the head of the screw 235 and rotating the screw 235.

The more the regulator(s) 234 are configured to block the flow through the regulation chamber 228, the higher the pressure P is during actuation of the lever arm 116*a*, and conversely, the less the regulator(s) 234 are configured to block the fluid flow through the regulation chamber 228, the lower the pressure P during actuation of the lever arm 116*a* is during actuation.

The actuator 104*a* can cause the toilet seat 112 to close softly as follows. When a patron wishes to lower the toilet seat 112 from the upright position, the patron triggers lowering of the toilet seat 112 by moving it (e.g., pulling toward him/her). This initial movement presses the toilet seat 112 against the lever arm 116*a*, which in turn rotates the pulley 218 clockwise, pulls on the cable 222, and begins moving the piston 224 from its resting position upward in the piston chamber 226 toward the inlet 210. Force from the weight of the toilet seat 112 moves the lever arm 116*a* the remainder of the distance to the lowered position B. However, to prevent the toilet seat 112 from slamming against the toilet bowl 202, the lever arm 116*a* resists against the movement of the toilet seat 112 to regulate its closure speed. This resistance is produced, at least in part, by the weight of the fluid in the piston chamber 226 above the piston 224 that is being displaced and the suction in the piston chamber 226 below the piston 224 caused by its upward movement. Resistance may also be produced by a rubber grommet (not shown) attached to the pulley 218 at the axle 248.

The construction details of the seat raising and lowering device 100, as shown in FIGS. 4A-4D for example, are that the mounting bracket 206, actuator 104*a*, lever arm 116*a*, regulator valve 234, actuator cable and piston assembly 114*a*, and seal 220 may be made of plastic, rubber, metal, polymer, carbon, alloys or any combination thereof, or any other sufficiently rigid and strong material.

Figure 5B:
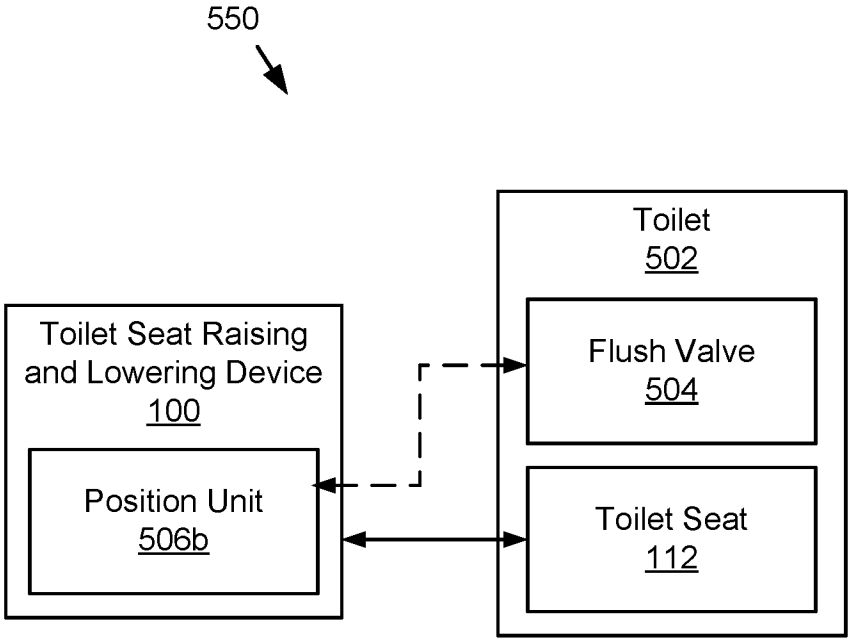
FIGS. 5A and 5B are block diagrams of example toilet flushing fluid conservation systems.
Figure 5A:
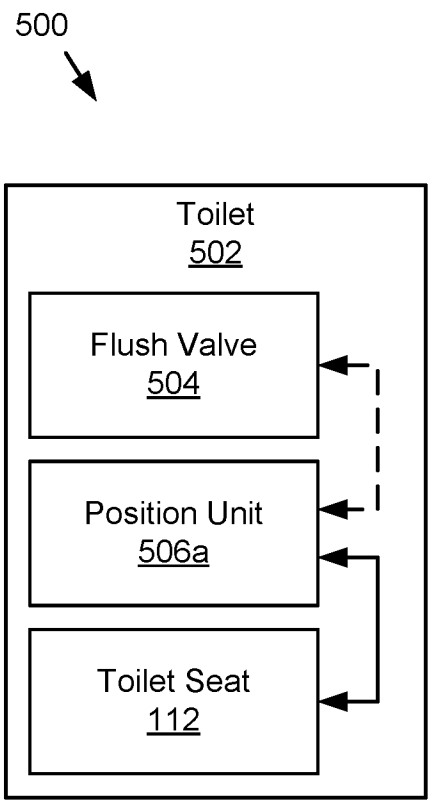

FIGS. 5A and 5B are block diagrams of example toilet flushing fluid conservation systems 500 and 550, respectively. The systems 500 and 550 may include a toilet 502 having a flush valve 504 and a toilet seat 112, as well as other elements that are not shown such as a tank or tankless configuration, a toilet bowl, etc., as discussed elsewhere here, such as with reference to FIG. 6. The systems 500 and 550 also include position units 506*a* and 506*b* (also individually and collectively referred to herein as 506). In some embodiments, the position unit 506 may be included with the toilet 502 as depicted by FIG. 5A. In other embodiments, the position unit 506 may be included with the toilet seat raising and lowering device 100 as depicted by FIG. 5B. The flush valve 504 may control the passage of the fluid used to flush the toilet 502, and may be the same as or substantially similar to the flush valve 240 discussed elsewhere herein. The position unit 506 may detect what position the toilet seat 112 is in and communicate the toilet seat 112's position to regulate how much fluid (e.g., water) is passed by the flush valve 504 to flush the toilet 502.

In systems 500 and 550, if the toilet seat 112 is located in position C (see FIG. 2B, for example), a male patron most likely deposited liquid waste (or mostly liquid waste) during his use of the toilet 502. In contrast, if the toilet seat 112 is located in position B, the male patron likely deposited solid waste or a combination of solid and liquid waste during his use of the toilet 502. As solid waste often requires more fluid to reliably flush, the position unit 506, either independently or in cooperation with another component (e.g., the flush valve 504), may permit more fluid to pass to flush the toilet 502 when the toilet seat 112 is in the lowered position B at the time the toilet 502 is flushed than when the toilet seat 112 is located in the raised position C. Conversely, the position unit 506, either independently or in cooperation with another component, may permit less fluid to pass to flush the toilet 502 when the toilet seat 112 is in the raised position C during use than when the toilet seat 112 is located in the lowered position B. This is beneficial as significant amounts of water may be conserved over a prolonged period of use of the toilet 502. For instance, in some embodiments, when the toilet seat 112 is in the raised position C, the system 500 or 550 may flush the toilet 502 using significantly less (e.g., 25%, 50%, or more) fluid (e.g., water) as compared to when the toilet seat 112 is located in the lowered position B.

Figure 6:
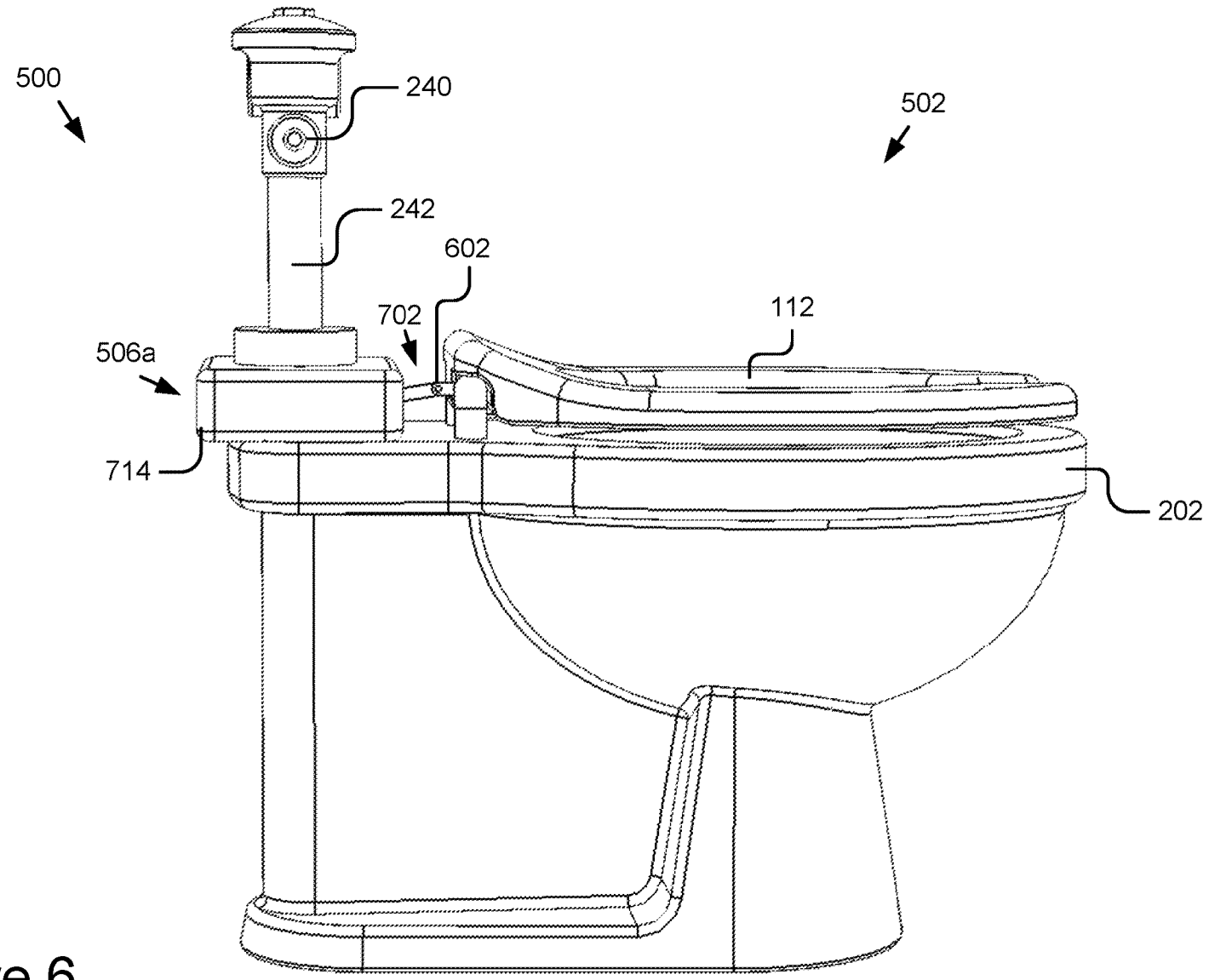
FIG. 6 is a side perspective view of an example toilet flushing fluid conservation system.

FIG. 6 is a side perspective view of an example toilet flushing fluid conservation system 500. As depicted in FIG. 6, the toilet 502 may include a toilet seat 112, a toilet bowl 202, a flush valve 240, a vertical pipe 242, and a position unit 506*a* having a position detector 702 configured to interact with the toilet seat 112 to detect its position and communicate the position to a fluid flow regulation component, such as the regulation valve 710 depicted in FIGS. 7A and 7B, the flush valve 240, or another component. In some embodiments, the position unit 506*a* may be situated proximate the toilet seat 112 along a flow path of the fluid used to flush the toilet 502. For example, as depicted in FIG. 6, the position unit 506*a* may be coupled to a bottom, output end of the vertical pipe 242 so the vertical pipe 242 can pass the fluid through a restrictable fluid flow chamber 712 (see FIGS. 7A and 7B) of position unit 506*a* into the toilet bowl 202.

In some embodiments, the position detector 702 may be a mechanism that physically detects the position of the toilet seat 112 through contact with it. For example, as depicted in FIG. 6, the position detector 702 may protrude outwardly from a housing 714 of the position unit 506*a* to connect to or otherwise contact the toilet seat 112. As a further example, the position detector 702 may be pivotably fastened to rear side of the toilet seat 112, and may be configured to articulate in conjunction with the toilet seat 112 when the toilet seat 112 is raised or lowered, as discussed further below with reference to FIGS. 7A and 7B. In this way, when the toilet seat 112 is moved from a raised position to a lowered position (or vice versa), the movement triggers the position detector 702, which in turn triggers a fluid flow regulation component, such as the regulation valve 710 depicted in FIGS. 7A and 7B, the flush valve 240, or another component, to adjust how much fluid will be used when flushing the toilet 502.

In some embodiments, the position unit 506 may be a retrofit component that is compatible with toilets that are already installed and in use. This is advantageous, as any existing toilet can be converted into one which conserves water by fitting the position unit 506 to it. In other embodiments, the toilet 502 may come pre-fitted with the position unit 506 or the position unit 506 may be integrated into the toilet 502.

Figure 7A:
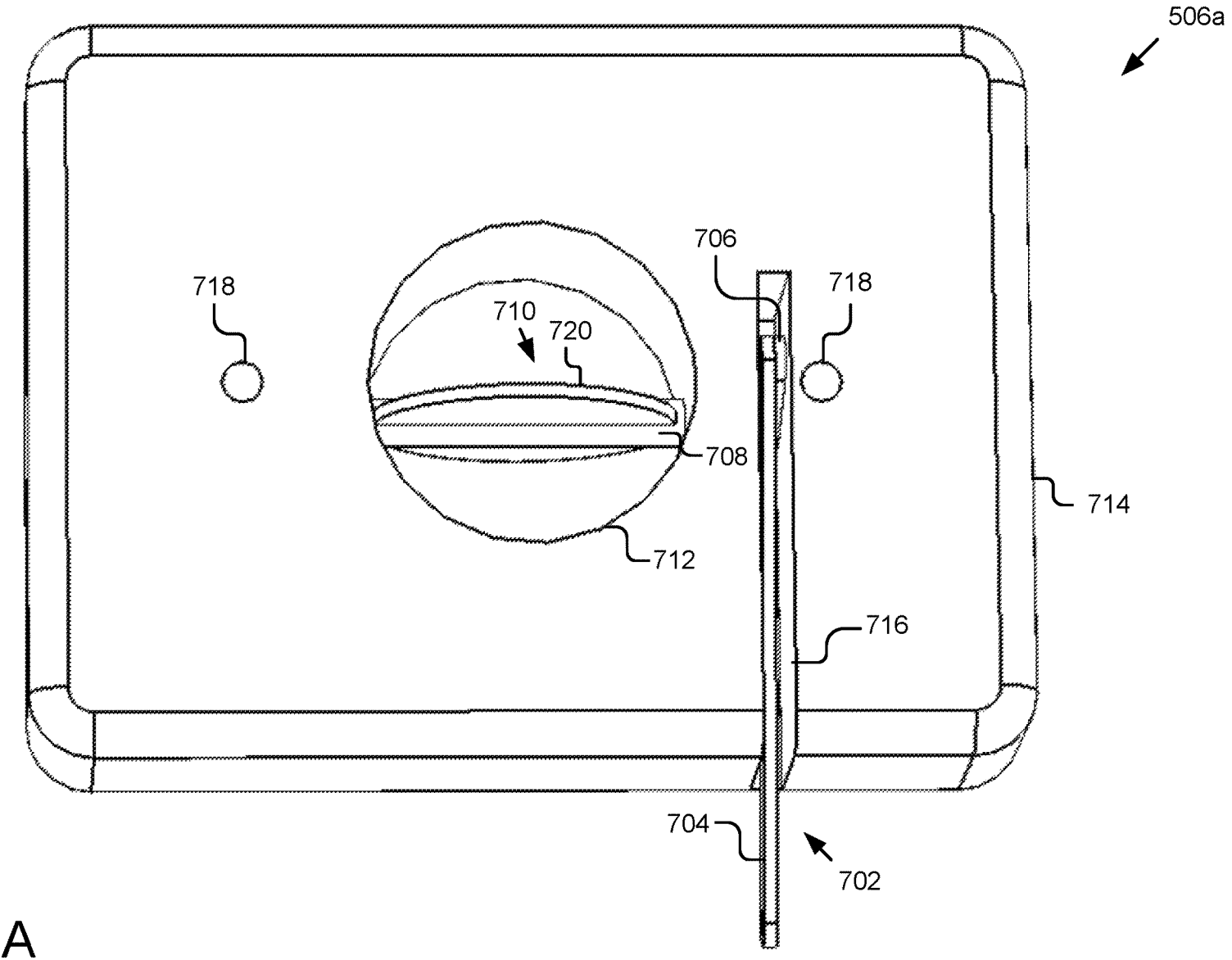
FIGS. 7A and 7B are bottom perspective and top transparent perspective views of an example position unit.
Figure 7B:
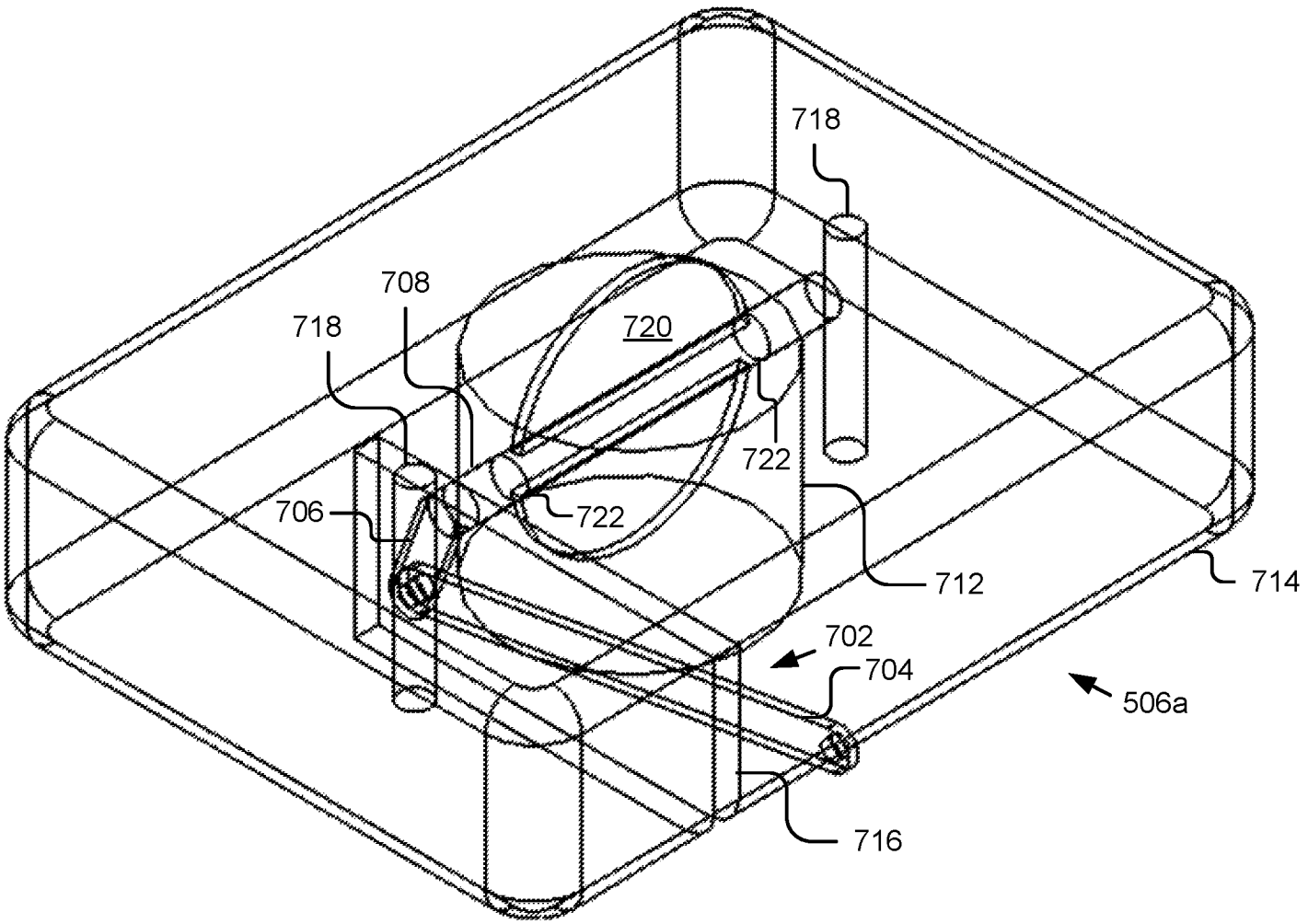

FIGS. 7A and 7B are bottom perspective and top transparent perspective views of an example position unit 506*a*. As illustrated, the position unit 506*a* may include a housing 714 that houses a flow regulation chamber 712, a regulation valve 710, and a position detector 702. The housing 714 may be attachable to the toilet 502 via one or more fastening elements. For example, the housing 714 may include two or more holes 718 that extend through the housing 714 and the toilet 502 may include corresponding fastening elements (not shown) configured to mate with the two or more holes 718. For instance, the toilet bowl 202 may include corresponding holes (not shown) that extend through a flange portion of the toilet bowl 202 (see FIG. 6) located on a rear side and configured to align with holes 718 of the housing 714 and accept fasteners (e.g., various nuts and bolts, etc.) to secure the position unit 506*a* to the toilet 502. However, it should be understood that any suitable fastening means may be used to fasten the housing 714 to the toilet 502, including screws, clamps, clips, snaps, etc. Further, in other embodiments, the position unit 506*a* may be made integral with other components of the toilet 502, including, for example, the vertical pipe 242, the flush valve 240, the toilet bowl 202, etc.

The position detector 702 may be an assembly configured to detect the position of the toilet seat 112 and coupled to the regulation valve 710 to open or close it based on the position of the toilet seat 112. In some embodiments, the position detector 702 may include a kinematic assembly having one end connected to the regulation valve 710 located within the flow regulation chamber 712 and another end connected to the toilet seat 112. In some embodiments, the position detector 702 may include a first mechanical link 704 and a second mechanical link 706. The first mechanical link 704 may be elongated and extend from the housing 714 to the toilet seat 112. The first link 704 may have holes at its proximal and distal ends. The distal end of the first link 704 may pivotably fasten to the toilet seat 112 via a fastener (e.g., screw, bolt, rivet, etc.) inserted through the hole and secured to the toilet seat 112. In some embodiments, the toilet seat 112 may include a post 602 (see FIG. 6) that extends outward from a rear surface of the toilet seat 112 that faces the position unit 506*a*, and the first link 704 may pivotably fasten to the toilet seat 112 via a fastener that extends through the hole in the distal end of the first link 704 and a corresponding hole included in the post 602.

In other embodiments, the position detector 702 may include an attachment device (not shown) configured to connect the first link 704 to the toilet seat 112. For example, in a retrofit application where a toilet seat 112 may lack a post 602, the attachment device (not shown) may pivotably fasten to the first link at one end via a hinge and may directly fasten to the toilet seat 112 at another end via a fastener (not shown). The fastener may include any fastening means or device capable of reliably attaching the attachment device to the toilet seat 112, such as, but not limited to, an eye bolt. In yet other embodiments where the toilet 502 is fitted with a toilet seat raising and lowering device 100 (not shown), the position detector 702 may be attached/fastened to the seat coupling device 116 (e.g., the lever arm 116*a*), the movement transmission mechanism 108 (e.g., the pulley 218, cable 222, etc.), or another portion of the toilet seat raising and lowering device 100 capable of indicating/signaling/transmitting the position of the toilet seat 112 to the position detector 702. It should be understood that the above embodiments for connecting the position detector 702 are provided by way of example, and that other equivalent ways of coupling the position detector 702 to the toilet seat 112 and/or toilet seat raising and lowering device 100 are contemplated and fall within the scope of this disclosure.

The proximal end of the first link 704 may moveably/pivotably fasten to the second link 706 at a lower end. The lower end of the second link 706 may include a hole that corresponds to the hole in the proximal end of the first link 704. A fastener (e.g., screw, bolt, rivet, etc.) may be inserted through the holes to pivotably fasten the first link 704 and the second link 706 together. An upper end of the second link 706 may be securely fixed (e.g., fastened, welded, joined, etc.) to the regulation valve 710 to rotate the valve 710 between a restrictive position and an open position when the toilet seat 112 is respectively moved between a raised position and a lowered position. In the restrictive position, the regulation valve 710 is configured to impede the flow of the fluid released by the flush valve 240 into the flow regulation chamber 712. In the open position, the regulation valve 710 is configured to allow the fluid released by the flush valve 240 to flow freely through the flow regulation chamber 712.

In some embodiments, the regulation valve 710 includes a throttle valve 720 situated within the flow regulation chamber 712 to throttle the fluid flow based on the position of the toilet seat 112. For example, the regulation valve 710 may include an axle 708 rotatably supported and secured by two diametrically opposed circular slots 722 formed in the sidewall of the flow regulation chamber 712. A throttle member 720 may be fixed to the axle 708 along a centerline and configured to rotate within the flow regulation chamber 712 when the axle 708 is rotated by the position detector 702. To rotate the axle 708 the second link 706 may, in some embodiments, be fixed to a proximal end of the axle 708 that extends through the circular slot 722 into a rectangular slot 716 that is formed in the housing 714 to accommodate the position detector 702. In some embodiments, the shape of the perimeter of the throttle member 720 corresponds with/matches the cross-sectional shape of the flow regulation chamber 712 so when the throttle member 720 is located in the restrictive position, it impedes the flow of the fluid passing through the flow-regulation chamber 712 by blocking (at least partially) the flow through the regulation chamber 712, and thus reduces the amount of fluid used to flush the toilet 502 during a flush cycle. For example, as depicted, the throttle member 720 may be disk-shaped and configured to have a circumference that ranges between substantially 0-50% less than a circumference of the tubular flow-regulation chamber, depending on the amount of fluid that should be restricted.

While the position unit 506*a* is depicted in FIG. 6 as being situated underneath the vertical pipe 242 behind the toilet seat 112, the position unit 506*a* may have other configurations adapted to provide the same functionality as that discussed above. For instance, in some embodiments, the position unit 506*a* may be attached to or integrated with other components of the toilet 502, the vertical pipe 242, the flush valve 240, the toilet bowl 202, a tank (not shown), etc., and configured to detect the position of the toilet seat 112 and communicate its position to a flow regulation component, such as the throttle valve 710, the flush valve 240, or another component.

In addition, in some embodiments, the position detector 702 and the valve 710 may be integrated. For example, while not depicted, the position unit 506 may have a gate valve configuration including a flat elongated rectangular gate having one end attached to the toilet seat 112 and another end that is configured to be slideably inserted into the vertical pipe 242 by the movement of the toilet seat 112 into the raised position and block (at least partially) the cross section of the vertical pipe 242. The gate may further be configured to slide out from the vertical pipe 242 when the toilet seat 112 is moved into the lowered position, thus allowing the fluid released by the flush valve 240 to freely pass through the vertical pipe 242.

The position unit 506 may additionally or alternatively include other components and/or assemblies for the position detector 702. For example, the position detector 702 may include elements such as springs, gears, cables, chains, rods, magnets, etc., to transmit the position of the toilet seat 112 to the valve 710. Moreover, the valve 710 may be a different type of valve, such as ball valve, globe valve, gate valve, needle valve, plug valve, etc., and may be mechanically or electronically activated by the position detector 702. For instance, the position detector 702 may include electronic sensors, including, for example, optical sensors, electronic switches, gyroscopes, etc., configured to sense the position of the toilet seat 112. These sensors may be electronically connected to the valve 710 to transmit a signal indicating the position of the toilet seat 112 to the valve 710. For instance, the sensor may be a gyroscope included on the toilet seat 112 that can detect the vertical and/or horizontal orientation of the toilet seat 112, a switch located on the rim of the toilet bowl 202 that can be contacted/triggered by the toilet seat 112 when it is in a lowered position, an optical sensor placed on the toilet 502 behind or underneath the toilet seat 112 to be triggered by the toilet seat 112 when it enters/obstructs the sensors field of view, etc.

As depicted by the dashed signal lines included in FIGS. 5A and 5B, in some embodiments, the throttle valve 710 may be omitted and the flush valve 504 may be configured to regulate the amount of fluid used to flush the toilet 502 based on a signal received from the position unit 506. For example, the flush valve 504 may be mechanically or electronically coupled to the position unit 506 to receive an electronic position signal indicating whether toilet seat 112 is located in position B or position C, and the flush valve 504 may regulate the fluid that passes through it based on the flush regulation signal. For example, the position unit 506 may include a sensor, as discussed elsewhere herein, that is situated in a location where it can electronically and/or optically sense what position the toilet seat 112 is in, electronically communicate the position to the flush valve 504, and the flush valve 504 can control how much fluid is released to flush the toilet 502 (e.g., by opening more or less widely, opening for a longer or shorter period of time, a combination of the foregoing, etc.) based on the signal received from the position unit 506.

In these embodiments, the flush valve 504 and the position unit 506 may be connected wirelessly (e.g., via embedded radio transceivers, infrared transceivers, etc.), may be connected using wires, or a combination of the foregoing. The flush valve 504 may include software, circuitry, hardware, etc., to regulate the flushing of the toilet 502. For example, the flush valve 504 may include a flush module (not shown) having logic operable by a processor (not shown) included in the toilet 502 to provide the functionality discussed herein. For instance, the flush module 504 may be stored in memory (not shown) included in the toilet 502 and operable by the processor (not shown) to perform this functionality. In further examples, may be implemented via a circuit, such as an integrated circuit (e.g., an ASIC); sets of instructions stored in one or more discrete memory devices (e.g., a PROM, FPROM, ROM) and operable by a processor; etc. In some embodiments, the flush valve 504 and/or the position unit 506 may be coupled to an electrical power source (not shown) to receive power to operate. For instance, the flush module 504 and/or the position unit 506 may be coupled to an electricity grid, a battery, a solar cell, a fluid powered generator and power storage device that generates power from fluid flow used to flush the toilet 502, etc.

With reference to FIG. 5B, the system 550 may, in some embodiments, include a toilet 502 and toilet seat raising and lowering device 100 (e.g., 100*a*) having a position unit 506*b*. The position unit 506*b* may be connected to or integrated with the toilet seat raising and lowering device 100 and configured to detect whether the toilet seat 112 is in the raised position C or lowered position B. In some embodiments, the position unit 506*b* can include a sensor placed proximate the movement transmission mechanism 108 (e.g., see FIG. 1A) to sense its position. For example, the movement transmission mechanism 108 may move to raise the toilet seat 112 to the raised position, and during such movement, may trigger the sensor (e.g., come into contact with a physical sensor of the position unit 506*b* such as a switch, cause a change to light (obstruct, distort, etc.) being received by an optical sensor of the position unit 506*b*, etc.), thus signaling the position unit 506*b* that the toilet seat 112 is in a raised position.

The advantages of the technology described herein include, without limitation, that it is small so as to be unobtrusive; simple so as to be easy to install, operate, and maintain; durable so as to provide many years of use; relatively inexpensive to own, small size so as to maintain the look and feel of the original toilet configuration, install and operate; and universal to work on all variations of toilets and toilet seats. The technology can be installed by a single individual in a matter of minutes on practically any existing toilet bowl/seat combination to provide its intended functionality. The technology can also conserve substantial amounts of fluid (e.g., water) that is used to flush the toilet, thus reducing costs and preserving the environment. The simple effectiveness and low cost of the technology help to make its use to solve a recognized problem more likely than the overly complicated and expensive related art or related art that may be relatively simple and/or inexpensive but requires user courtesy and action for embodiment.

In the foregoing description, for purposes of explanation, numerous specific details are set forth in order to provide a thorough understanding of the technology. It will be apparent, however, that the technology described herein can be practiced without these specific details. In other instances, structures and devices are shown in block diagram form in order to avoid obscuring the invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A flushing system comprising:

a flush valve signal generator configured to send an electric signal responsive to an opening of a flush valve of a toilet that releases a flushing fluid into a toilet bowl of the toilet; and an electric movement source electrically connected to the flush valve signal generator, the electric movement source being triggerable by the electric signal sent to the electric movement source responsive to the opening of the flush valve of the toilet, the electric movement source raising a toilet seat of the toilet from a lowered position to a raised position responsive to receiving the electric signal.

2. The flushing system of claim 1, wherein:

the electric movement source is an electric motor; and the electric signal triggering the electric movement source responsive to the opening of the flush valve of the toilet is one of an electromagnetic signal and an electric current.

3. The flushing system of claim 1, wherein:

the electric movement source is attached to one or more of the toilet bowl, the toilet seat, and a toilet tank of the toilet.

4. The flushing system of claim 1, wherein:

the electric movement source is integrated into one or more of the toilet bowl, the toilet seat, and a toilet tank of the toilet.

5. The flushing system of claim 1, wherein:

the electric movement source generates a force to raise the toilet seat from the lowered position to the raised position responsive to receiving the electric signal.

6. The flushing system of claim 5, further comprising:

a movement transmission mechanism being connected to the electric movement source to receive the force and being coupleable to the toilet seat to transfer the force to the toilet seat to raise the toilet seat from the lowered position to the raised position.

7. The flushing system of claim 6, wherein:

the movement transmission mechanism being integrated into the toilet seat.

* * * * *